US009724944B2

(12) United States Patent
Takada

(10) Patent No.: US 9,724,944 B2
(45) Date of Patent: Aug. 8, 2017

(54) RECORDING HEAD, RECORDING HEAD ADJUSTING SYSTEM, AND RECORDING HEAD ADJUSTING METHOD

(71) Applicant: FUJIFILM Corporation, Tokyo (JP)

(72) Inventor: Norihisa Takada, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/348,339

(22) Filed: Nov. 10, 2016

(65) Prior Publication Data

US 2017/0057262 A1 Mar. 2, 2017

Related U.S. Application Data

(63) Continuation of application No. PCT/JP2015/063350, filed on May 8, 2015.

(30) Foreign Application Priority Data

Jun. 23, 2014 (JP) ..... 2014-127961

(51) Int. Cl.
*B41J 25/00* (2006.01)
*B41J 2/21* (2006.01)
(Continued)

(52) U.S. Cl.
CPC ..... *B41J 25/001* (2013.01); *B41J 2/01* (2013.01); *B41J 2/2146* (2013.01); *B41J 2/447* (2013.01);
(Continued)

(58) Field of Classification Search
CPC ..... B41J 25/001; B41J 25/003; B41J 2/2146; B41J 2/447; B41J 2/45
See application file for complete search history.

(56) References Cited

U.S. PATENT DOCUMENTS 7,578,578 B2 8/2009 Akahane
8,342,653 B2 1/2013 Akahane
(Continued)

FOREIGN PATENT DOCUMENTS

JP 2007-001107 A 1/2007
JP 2008-183903 A 8/2008
(Continued)

OTHER PUBLICATIONS

International Search Report issued in PCT/JP2015/063350; mailed Jul. 14, 2015.
(Continued)

*Primary Examiner* — Jason Uhlenhake
(74) *Attorney, Agent, or Firm* — Studebaker & Brackett PC

(57) ABSTRACT

The present invention provides a recording head, a recording head adjusting system, and a recording head adjusting method. A recording head includes: a head module having a recording surface; a support member that supports the head module; a first direction position adjusting unit that adjusts the first-direction position of the head module; a rotation direction adjusting unit that adjusts the angular deviation of the rotation direction; and a position detection unit that detects the first-direction position of the head module that is used when performing adjustment by the first direction position adjusting unit and the rotation direction adjusting unit. The rotation direction adjusting unit includes a rotation support mechanism for rotatably supporting the head module within the plane parallel to the recording surface and a second direction moving mechanism for moving the adjustment position of the head module in a second direction perpendicular to the first direction.

20 Claims, 18 Drawing Sheets

(51) Int. Cl.

| | |
|---|---|
| ***B41J 2/01*** | (2006.01) |
| ***B41J 2/447*** | (2006.01) |
| ***B41J 2/45*** | (2006.01) |
| ***B41J 25/304*** | (2006.01) |

(52) U.S. Cl.
CPC ..... *B41J 2/45* (2013.01); *B41J 25/003* (2013.01); *B41J 25/304* (2013.01)

(56) References Cited

U.S. PATENT DOCUMENTS

| | | | | |
|---|---|---|---|---|
| 9,248,677 | B2 | 2/2016 | Takada et al. | |
| 9,283,768 | B2 | 3/2016 | Akahane | |
| 2009/0284556 | A1* | 11/2009 | Okazawa | B41J 25/308 347/8 |
| 2010/0245477 | A1* | 9/2010 | Ohkubo | B41J 2/14233 347/47 |
| 2015/0306870 | A1* | 10/2015 | Sumiyoshi | B41J 2/2146 347/9 |

FOREIGN PATENT DOCUMENTS

| | | | |
|---|---|---|---|
| JP | 2008-279695 | A | 11/2008 |
| JP | 2013-203028 | A | 10/2013 |
| JP | 2013-230678 | A | 11/2013 |
| JP | 2014-073660 | A | 4/2014 |
| WO | 2014/054614 | A1 | 4/2014 |

OTHER PUBLICATIONS

Written Opinion issued in PCT/JP2015/063350; mailed Jul. 14, 2015.

* cited by examiner

RECORDING HEAD, RECORDING HEAD ADJUSTING SYSTEM, AND RECORDING HEAD ADJUSTING METHOD

CROSS-REFERENCE TO RELATED APPLICATIONS

This application is a Continuation of PCT International Application No. PCT/JP2015/063350 filed on May 8, 2015, which claims priority under 35 U.S.C §119(a) to Japanese Patent Application No. 2014-127961 filed on Jun. 23, 2014. Each of the above application(s) is hereby expressly incorporated by reference, in its entirety, into the present application.

BACKGROUND OF THE INVENTION

1. Field of the Invention

The present invention relates to a recording head, a recording head adjusting system, and a recording head adjusting method, and relates to a technique of adjusting the position of a recording head, such as an ink jet head.

2. Description of the Related Art

An image recording apparatus including a recording head, such as an ink jet head, performs mechanical adjustment when installing the recording head, so that a predetermined mechanical tolerance is satisfied for the placement of the recording head.

JP2013-203028A discloses a recording head including a plurality of head modules, which has a configuration in which the position of each head module is detected using a position detection unit, position adjustment data indicating the amount of correction required for adjustment of a head module to be adjusted is calculated from the information of the detected position of each head module and the target position of each head module, and the position of each head module is adjusted using a position adjusting unit.

As the terms for the recording head, the position detection unit, and the position adjusting unit, terms for an ink jet head, a magnetic sensor, and a position adjustment mechanism are respectively used in JP2013-203028A.

JP2007-1107A discloses an image recording apparatus for realizing alignment with high accuracy with a simple structure and operation for both the inclination of a recording element column and the absolute position of a recording head. JP2007-1107A discloses a configuration in which two eccentric cam members are arranged on one side surface of the recording head so as to be spaced apart from each other along the one side surface of the recording head and the inclination with respect to the surface, on which the eccentric cams are arranged, is adjusted by adjusting only one of the eccentric cam members.

As the terms for the recording element and the recording head, terms for a nozzle and an injection head are respectively used in JP2007-1107A. In addition, as the term for the image recording apparatus, a term for a liquid ejection apparatus or a recording apparatus is used in JP2007-1107A.

JP2013-230678A discloses a method of aligning head modules in a recording head including a plurality of head modules. JP2013-230678A discloses a configuration including a first alignment mechanism, a second alignment mechanism, and a third alignment mechanism for performing alignment for three straight line directions perpendicular to each other and three angular directions perpendicular to each other.

As the term for the recording head, a term for a print head is used in JP2013-230678A.

SUMMARY OF THE INVENTION

The recording head disclosed in JP2013-203028A has a position adjusting unit only for the arrangement direction of head modules, so that alignment of the head modules is performed using a mechanical method for the arrangement direction. Positional deviation between the head modules in the paper transport direction perpendicular to the arrangement direction is solved by adjusting the jetting timing for each head module.

On the other hand, there is no adjustment function for the rotation direction of the head module within the plane parallel to the recording surface. However, by performing the assembly of the recording head with high accuracy, error in the rotation direction of the head module is suppressed so as not to cause substantial image defects.

If there is a high demand for resolution and image quality, in a case where the error in the rotation direction of the head module and a variation in the jetting direction of ink are combined, even a very small angular deviation amount can be recognized as an image defect. Therefore, there is demand for preventing the occurrence of image defects, which can be visually recognized due to angular deviation in the rotation direction of the head module, by enabling the adjustment of the angular deviation amount of the rotation direction of the head module.

The image recording apparatus disclosed in JP2007-1107A can adjust the inclination with respect to the direction in which the eccentric cams are arranged. The adjustment of the inclination with respect to the direction in which the eccentric cams are arranged in the image recording apparatus disclosed in JP2007-1107A is substantially the same as the adjustment of the rotation direction of the head module within the plane parallel to the recording surface.

In the case of accurately adjusting the inclination with respect to the direction in which the eccentric cams are arranged, it is necessary to detect the amount of inclination and check the adjustment result. However, there is neither description regarding detection of the amount of inclination nor description checking of the adjustment result in JP2007-1107A. That is, in the image recording apparatus disclosed in JP2007-1107A, it is difficult to accurately adjust the inclination with respect to the direction in which the eccentric cams are arranged.

The ink jet head disclosed in JP2013-230678A performs alignment using an alignment device. The alignment device is a combination of a high-magnification camera and a low-magnification camera. Accordingly, when aligning the head modules, an alignment device having a large-scale configuration is required.

The present invention has been made in view of such a situation, and it is an object of the present invention to provide a recording head, a recording head adjusting system, and a recording head adjusting method capable of accurately adjusting the angular deviation of the rotation direction within the plane parallel to the recording surface of the recording head using a simple configuration.

In order to achieve the aforementioned object, the following aspects of the invention are provided.

A recording head according to a first aspect comprises: a head module having a recording surface on which recording elements are arranged; a support member that supports the head module; a first direction position adjusting unit that adjusts a first-direction position of the head module with respect to the support member; a rotation direction adjusting unit that adjusts angular deviation of a rotation direction within a plane parallel to the recording surface of the head module with respect to the support member; and a position detection unit that detects the first-direction position of the head module with respect to the support member, which is used when performing adjustment by the first direction position adjusting unit and adjustment by the rotation direction adjusting unit. The rotation direction adjusting unit includes a rotation support mechanism, through which a rotation axis of the head module passes along a direction perpendicular to the recording surface and which rotatably supports the head module within the plane parallel to the recording surface, and a second direction moving mechanism that moves an adjustment position of the head module, which is spaced apart from the rotation support mechanism to the first direction, to a second direction perpendicular to the first direction.

According to the aspect, it is possible to adjust the angular deviation of the rotation direction within the plane parallel to the recording surface of the head module with high accuracy using a simple configuration.

As an example of the recording head, an ink jet head including nozzles, through which liquid is jetted, as recording elements can be mentioned.

According to a second aspect, in the recording head according to the first aspect, the rotation support mechanism is disposed at one end of the head module in the second direction that is one end of the head module in the first direction and, the second direction moving mechanism is disposed at the one end of the head module in the second direction that is the other end of the head module in the first direction, and the position detection unit comprises a sensor and a detection piece detected by the sensor, and either the sensor or the detection piece is disposed at the other end of the head module in the second direction that is the one end of the head module in the first direction.

According to the aspect, even in a case where the angular deviation amount of the rotation direction is very small, it is possible to adjust the angular deviation of the rotation direction with high accuracy.

As an example of the sensor, a magnetic sensor can be mentioned. As an example of the detection piece corresponding to the magnetic sensor, a magnet can be mentioned.

According to a third aspect, in the recording head according to the second aspect, the head module includes a head unit having a recording surface on which recording elements are arranged, and an attachment unit to which the head unit is attached. The attachment unit includes a vertical portion that has a length exceeding a total length of the head unit in the first direction, has protruding portions that protrude to both sides of the head unit, and is provided at the one end of the head module in the second direction so as to be perpendicular to the plane parallel to the recording surface. In the vertical portion, the rotation support mechanism is provided in one of the protruding portions that protrude to both sides of the head unit in the first direction, and the second direction moving mechanism is provided in the other protruding portion.

According to the aspect, the structure of the head module is simplified by arranging the rotation direction adjusting unit in the attachment unit to which the head unit is attached.

According to a fourth aspect, in the recording head according to the third aspect, the attachment unit includes a horizontal portion that supports a periphery of a surface of the head unit on an opposite side of the recording surface from the opposite side of the recording surface and that has a structure in which the vertical portion is bonded to the one end in the second direction. The horizontal portion is at a position corresponding to a position of the rotation support mechanism in the first direction, and either the sensor or the detection piece is disposed at the other end in the second direction.

According to the aspect, since a sensor or a detection piece is disposed at the end on the opposite side of the rotation support mechanism in the second direction, it is possible to monitor the result of adjustment of the head module with high accuracy even if the adjustment of the angular deviation of the rotation direction is very small.

According to a fifth aspect, in the recording head according to any one of the first to fourth aspects, the recording head has a structure in which a plurality of the head modules are arranged side by side in the first direction.

According to the aspect, adjustment of positional deviation in the rotation direction can be performed for each head module.

According to a sixth aspect, in the recording head according to any one of the first to fourth aspects, the recording head includes only one of the head module having a structure in which a longitudinal direction is parallel to the first direction.

According to the aspect, it is particularly effective for the adjustment of the entire full-line type recording head in which recording elements are arranged over a length equal to or greater than the entire width of paper.

A recording head adjusting system according to a seventh aspect comprises: a recording head which has a structure in which a head module having a recording surface on which recording elements are arranged is supported by a support member, which includes a first direction position adjusting unit that adjusts a first-direction position of the head module with respect to the support member, a rotation direction adjusting unit that adjusts angular deviation of a rotation direction of the head module within a plane parallel to the recording surface, and a position detection unit that detects the first-direction position of the head module with respect to the support member, which is used when performing adjustment by the first direction position adjusting unit and adjustment by the rotation direction adjusting unit, and in which the rotation direction adjusting unit includes a rotation support mechanism, through which a rotation axis of the head module passes along a direction perpendicular to the recording surface and which rotatably supports the head module within the plane parallel to the recording surface, and a second direction moving mechanism that moves an adjustment position of the head module, which is spaced apart from the rotation support mechanism to the first direction, to a second direction perpendicular to the first direction; an information acquisition unit that acquires an angular deviation amount of the rotation direction within the plane parallel to the recording surface of the head module with respect to the support member; an adjustment value deriving unit that derives, based on the acquired angular deviation amount, an adjustment value of the second direction moving mechanism when adjusting the angular deviation of the rotation direction within the plane parallel to the recording surface of the head module with respect to the support member; and a determination unit that determines whether or not the adjustment of the angular deviation of the rotation direction within the plane parallel to the recording surface of the head module with respect to the support member has been performed appropriately, based on the first-direction position of the head module detected by the position detection unit, when performing adjustment by the second direction moving mechanism.

According to the aspect, it is possible to perform the adjustment of the positional deviation of the first direction and the adjustment of the angular deviation of the rotation direction with high accuracy using a simple configuration. In addition, high-quality image recording is realized using a recording head after adjustment.

According to an eighth aspect, in the recording head adjusting system according to the seventh aspect, as a reference for determining whether or not the adjustment of the angular deviation of the rotation direction within the plane parallel to the recording surface of the head module with respect to the support member has been performed appropriately, the determination unit uses a value obtained by multiplying a distance in the second direction from the rotation support mechanism to the position detection unit by an adjustment value of the second direction moving mechanism and dividing the value obtained by the multiplication by a first-direction total length of a recording element arrangement region where the recording elements of the head module are arranged.

According to the aspect, based on the reference value derived by using the adjustment value in the adjustment of the angular deviation of the rotation direction, it is possible to determine whether or not the adjustment of the angular deviation of the rotation direction has been performed appropriately.

According to a ninth aspect, in the recording head adjusting system according to the eighth aspect, the adjustment value deriving unit derives a value, which is obtained by multiplying the acquired angular deviation amount of the rotation direction within the plane parallel to the recording surface of the head module with respect to the support member by a distance in the second direction from the rotation support mechanism to the second direction moving mechanism, as an adjustment value of the second direction moving mechanism.

According to the aspect, an adjustment value suitable for the configuration of the rotation direction adjusting unit is derived.

According to a tenth aspect, the recording head adjusting system according to any one of the seventh to ninth aspects further comprises a reading unit that reads a test chart formed using a head module to be adjusted.

According to the aspect, compared with a case of using an external device as a reading unit that reads a test chart formed using a head module to be adjusted, it is possible to shorten the processing time until the adjustment value is derived.

According to an eleventh aspect, the recording head adjusting system according to any one of the seventh to tenth aspects further comprises a display unit that displays a determination result of the determination unit.

According to the aspect, it is possible to determine whether or not adjustment has been performed appropriately based on the display result of the determination unit.

According to a twelfth aspect, in the recording head adjusting system according to any one of the seventh to eleventh aspects, the recording head includes the recording head according to any one of the second to sixth aspects.

A recording head adjusting method according to a thirteenth aspect is a method of adjusting a recording head in which a head module having a recording surface on which recording elements are arranged is supported by a support member, and includes: a first direction position adjusting step of adjusting a first-direction position of the head module with respect to the support member; a rotation direction adjusting step of adjusting angular deviation of a rotation direction within a plane parallel to the recording surface of the head module with respect to the support member; and a detection step of detecting the first-direction position of the head module with respect to the support member, which is used in the first direction position adjusting step and the rotation direction adjusting step. In the rotation direction adjusting step, an adjustment position of the head module spaced apart to the first direction from a rotation support mechanism, through which a rotation axis of the head module passes along a direction perpendicular to the recording surface and which rotatably supports the head module within the plane parallel to the recording surface, is moved to a second direction perpendicular to the first direction.

According to a fourteenth aspect, the recording head adjusting method according to the thirteenth aspect further includes a determination step of determining whether or not the adjustment of the angular deviation of the rotation direction within the plane parallel to the recording surface of the head module with respect to the support member has been performed appropriately in the rotation direction adjusting step, based on the first-direction position of the head module detected in the detection step.

According to a fifteenth aspect, in the recording head adjusting method according to the fourteenth aspect, in the determination step, as a reference for determining whether or not the adjustment of the angular deviation of the rotation direction within the plane parallel to the recording surface of the head module with respect to the support member has been performed appropriately in the rotation direction adjusting step, a value obtained by multiplying a distance in the second direction from the rotation support mechanism to a first direction detection position of the head module by an adjustment value in the second direction and dividing the value obtained by the multiplication by a first-direction total length of a recording element arrangement region where the recording elements of the head module are arranged is used.

According to the present invention, it is possible to adjust the angular deviation of the rotation direction within the plane parallel to the recording surface of the head module with high accuracy using a simple configuration.

DESCRIPTION OF THE PREFERRED EMBODIMENTS

Hereinafter, preferred embodiments of the present invention will be described in detail with reference to the accompanying diagrams.

[Overall Configuration of an Ink Jet Head]

Figure 1:
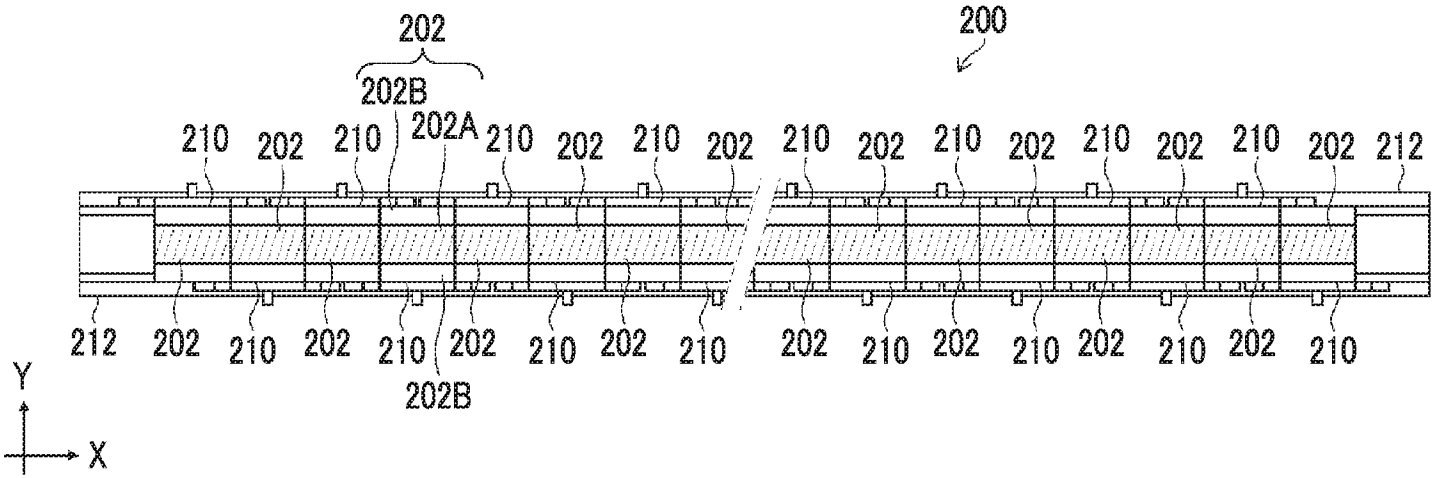
FIG. 1 is a plan view schematically showing an ink jet head.

FIG. 1 is a plan view schematically showing an ink jet head according to an embodiment of the present invention, and is a diagram viewed from the nozzle surface side.

An ink jet head 200 shown in FIG. 1 functions as a recording head mounted in an image recording apparatus, such as an ink jet recording apparatus. The ink jet head 200 is formed by connecting a plurality of head modules 210 to each other in a column. The head modules 210 have the same structure, and one ink jet head 200 is formed by attaching the head modules 210 to a base frame 212, which functions as a support member, side by side in a column.

The arrangement direction of the head module 210 is assumed to be an X direction, and a direction perpendicular to the arrangement direction of the head module 210 is assumed to be a Y direction. The X direction corresponds to a first direction, and the Y direction corresponds to a second direction. The X and Y directions are parallel to a nozzle surface 202. In addition, a direction that is perpendicular to the nozzle surface 202 and is perpendicular to the X and Y directions is assumed to be a Z direction. In FIG. 1, illustration of the Z direction is omitted.

The term for "perpendicular" in this specification includes "substantially perpendicular" capable of obtaining the same effect as in a case where two directions are perpendicular to each other at an angle of 90°, in a case in which two directions are perpendicular to each other at an angle less than 90° and a case in which two directions are perpendicular to each other at an angle exceeding 90°. In addition, the term for "parallel" includes a case in which the same effect as in the case of "parallel" is obtained even though two directions are cross with each other.

The nozzle surface 202 shown in FIG. 1 corresponds to a recording surface. The nozzle surface 202 includes a nozzle arrangement region 202A where nozzles are arranged and a guide member 202B for supporting the nozzle arrangement region from both sides. In FIG. 1, reference numerals of the nozzle arrangement region 202A and the guide member 202B are given only to one head module 210, and other head modules 210 are denoted by only reference numeral 202. The nozzle arrangement region 202A corresponds to a recording element arrangement region.

The head module 210 alone can function as an ink jet head. By connecting a plurality of head modules 210 to each other along the X direction, one line-type ink jet head is formed.

In the ink jet head 200 shown in FIG. 1, a plurality of nozzles are arranged in a matrix. The matrix arrangement of nozzles indicates a nozzle arrangement, in which a plurality of nozzles are arranged at equal intervals in the X direction, in a projected nozzle column in which a plurality of nozzles are projected in the X direction so as to be arranged along the X direction. In FIG. 1, illustration of individual nozzles is omitted, and a nozzle column along a column direction perpendicular to the Y direction is shown by dotted lines.

[Description of a Rotation Direction Adjusting Unit]

Figure 2:
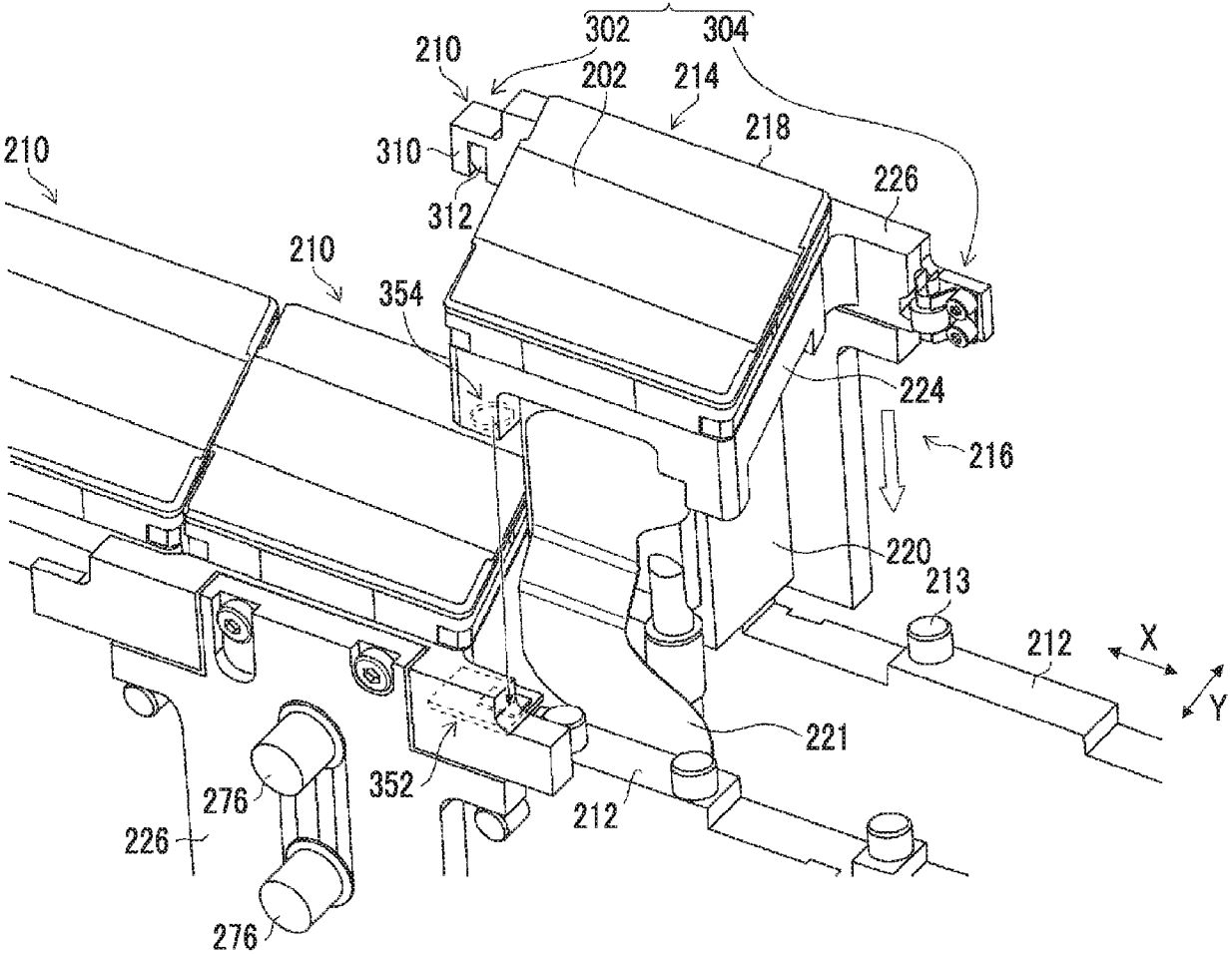
FIG. 2 is a perspective view showing the configuration of a rotation direction adjusting unit.

FIG. 2 is a perspective view showing the configuration of a rotation direction adjusting unit, and shows the head module 210 with the nozzle surface 202 facing upward.

A rotation direction adjusting unit 300 adjusts the angular deviation of the rotation direction within the plane parallel to the nozzle surface 202 of the head module 210.

The plane parallel to the nozzle surface 202 is a plane that is parallel to the X and Y directions and is perpendicular to the Z direction.

In the following explanation, it is assumed that the simple description of a rotation direction indicates a rotation direction within the plane parallel to the nozzle surface 202 and that a rotation axis passing through a rotation support mechanism 302, which will be described later, is parallel to the Z direction.

FIG. 2 shows a state in which one of the plurality of head modules 210 attached to the base frame 212 is detached from the base frame 212. A downward straight arrow shown in FIG. 2 shows the mounting direction of the head module 210 with respect to the base frame 212. A member denoted by reference numeral 276 in FIG. 2 is a pair of Y-direction guide posts to be described later.

The head module 210 has a structure in which a head unit 214 is attached to a bracket 216. The head unit 214 is configured to include a main body portion 218 and an electrical and piping portion 220 including an electrical component and a pipe. A component denoted by reference numeral 221 is a flexible flat substrate attached to the electrical and piping portion 220.

The bracket 216 that functions as an attachment unit of the head unit 214 is configured to include a horizontal portion 224 and a vertical portion 226, and the vertical portion 226 is bonded to the one end of the horizontal portion 224 in the Y direction. The head unit 214 is attached to the horizontal portion 224. A structure for attaching the head module 210 to the base frame 212 is provided in the vertical portion 226.

When adjusting the angular deviation of the rotation direction within the plane parallel to the nozzle surface 202 of the head module 210, the rotation direction adjusting unit 300 moves the adjustment position of the head module 210, which is spaced apart from the position of the rotation axis to the X direction, to the Y direction.

The rotation direction adjusting unit 300 is configured to include the rotation support mechanism 302, which rotatably supports the head module 210 within the plane parallel to the nozzle surface 202, and a Y-direction moving mechanism 304 that functions as a second direction moving mechanism. The rotation support mechanism 302 is provided at the one end of the vertical portion 226 of the bracket 216 in the X direction, and the Y-direction moving mechanism 304 is provided at the other end.

The rotation support mechanism 302 is configured to include a housing 310 and a steel ball 312 inserted into the housing 310, and functions as a structure for rotatably supporting the head module 210 when rotating the head module 210 within the plane parallel to the nozzle surface.

Figure 3:
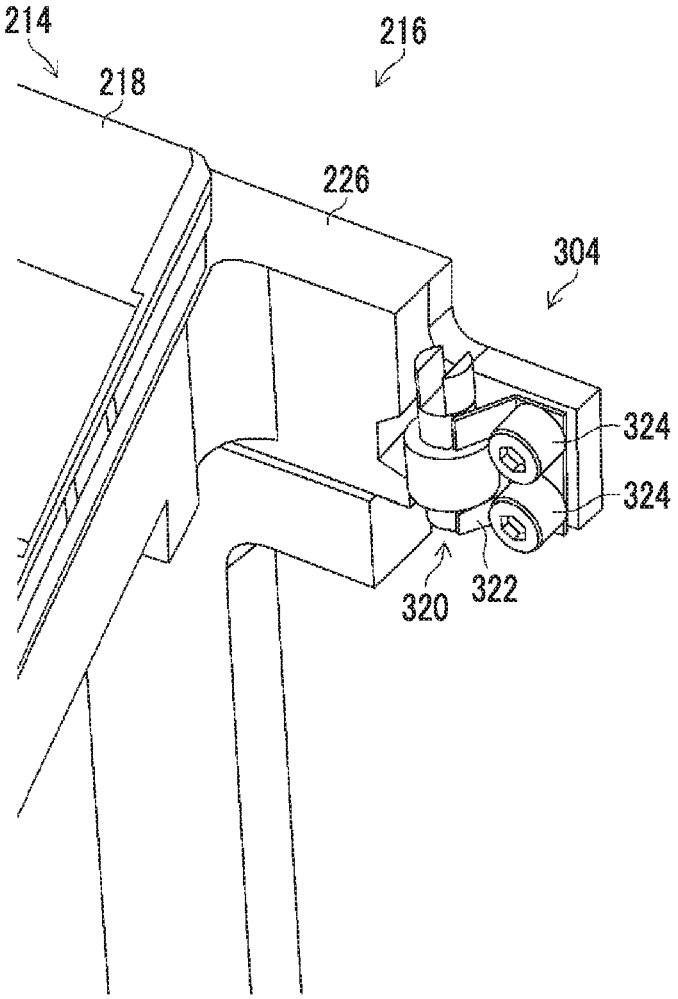
FIG. 3 is a perspective view showing the configuration of a Y-direction moving mechanism.

Reference numeral of the configuration of the Y-direction moving mechanism 304 is omitted in FIG. 2, and the configuration of the Y-direction moving mechanism 304 is denoted by reference numeral in FIG. 3. A structure denoted by reference numeral 213 in FIG. 2 is a positioning pin that is provided in the base frame 212 and functions as an adjustment reference of the Y-direction moving mechanism 304.

Figure 10:
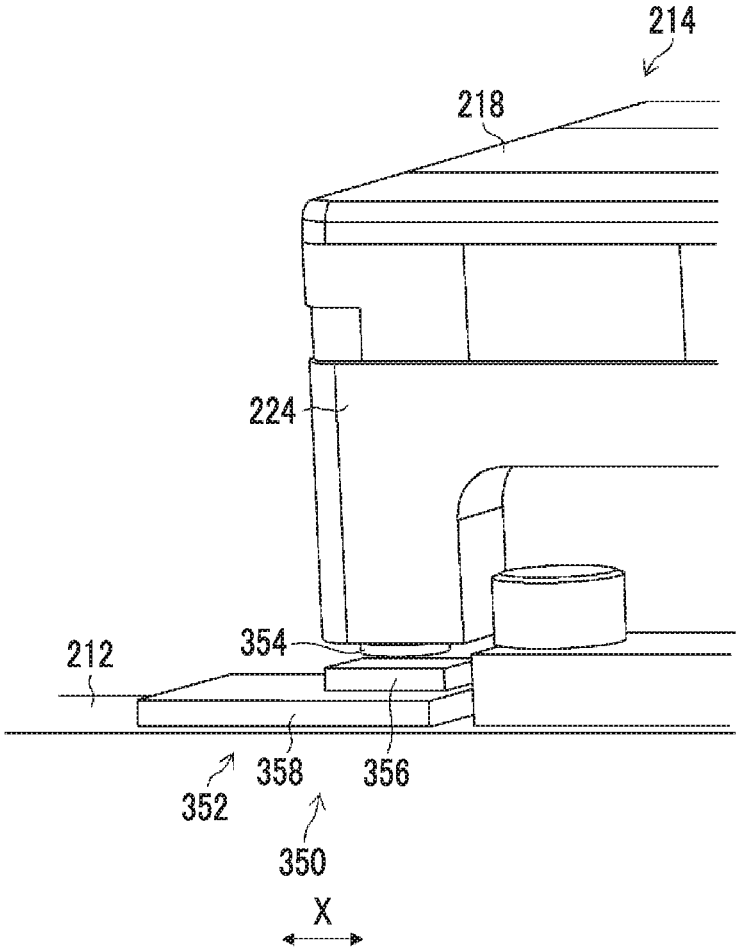
FIG. 10 is an explanatory diagram showing an example of the arrangement of a magnetic sensor and a magnet.

In FIG. 2, a magnetic sensor denoted by reference numeral 352 is shown by the dotted line. In addition, a magnet denoted by reference numeral 354 is shown by the dotted line. The magnetic sensor 352 and the magnet 354 form a position detection unit. The position detection unit denoted by reference numeral 350 is shown in FIG. 10. The details of the position detection unit will be described later.

FIG. 3 is a perspective view showing the configuration of the Y-direction moving mechanism 304, and is a partially enlarged view of the main body portion 218 of the head unit 214 and the bracket 216. The Y-direction moving mechanism 304 is configured to include an eccentric cam 320, a pressing plate 322 for fixing the eccentric cam 320, and a screw 324 for attaching the pressing plate 322 to the vertical portion 226.

Figure 4:
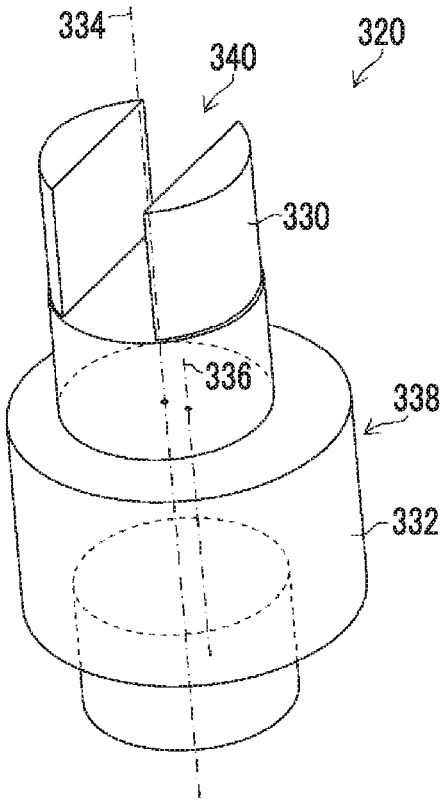
FIG. 4 is a front view of an eccentric cam provided in the Y-direction moving mechanism shown in FIG. 3.

FIG. 4 is a perspective view of the eccentric cam 320. The eccentric cam 320 is configured to include a rotating portion 330 and a cam portion 332. The eccentric cam 320 has a structure in which a rotation axis 334 of the rotating portion 330 and a rotation axis 336 of the cam portion 332 are shifted from each other.

When rotating the rotating portion 330 around the rotation axis 334, a peripheral surface 338 of the cam portion 332 forms a cam track. A groove 340 is provided in the rotating portion 330, so that it is possible to rotate the eccentric cam 320 by rotating the groove 340.

Figure 5A:
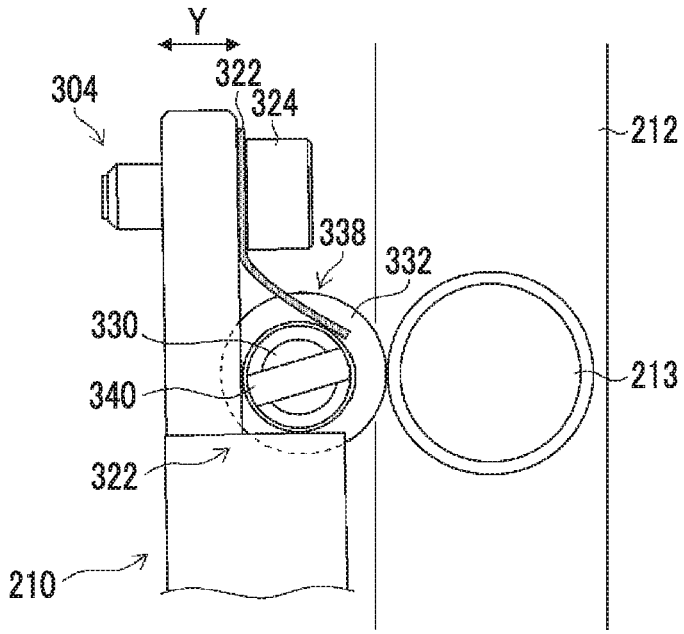
FIG. 5A is a schematic diagram of a state in which a head module is attached to a base frame.
Figure 5B:
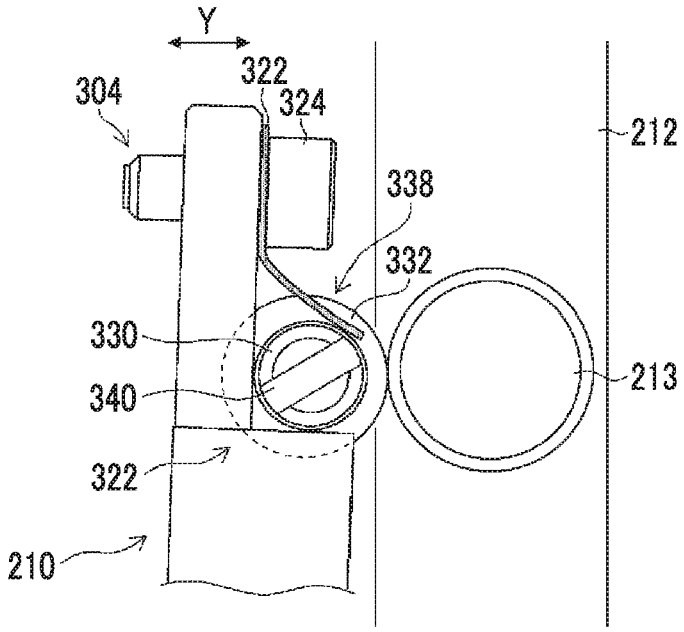
FIG. 5B is a schematic diagram of the adjustment of the Y-direction moving mechanism.

FIG. 5A is a schematic diagram of a state in which the head module 210 is attached to the base frame 212. FIG. 5B is a schematic diagram of the adjustment of the Y-direction moving mechanism 304.

As shown in FIGS. 5A and 5B, when the head module 210 is attached to the base frame 212, the peripheral surface 338 of the cam portion 332 is brought into contact with the positioning pin 213 of the base frame 212.

By rotating the rotating portion 330 in a state in which the peripheral surface 338 of the cam portion 332 is in contact with the positioning pin 213 of the base frame 212, it is possible to move the Y-direction position of the head module 210 with respect to the positioning pin 213 of the base frame 212.

That is, by rotatably supporting one point of the head module 210 in the X direction within the plane parallel to the nozzle surface 202 using the rotation support mechanism 302, where the nozzle surface 202 and he rotation support mechanism 302 are not shown in FIGS. 5A and 5B, and moving one point of the head module 210, which is different from the rotation support mechanism 302 and is spaced apart from the rotation support mechanism 302 in the X direction, to the Y-direction using the Y-direction moving mechanism 304 shown in FIGS. 5A and 5B, it is possible to rotate the head module 210 within the plane parallel to the nozzle surface 202. As a result, it is possible to adjust the rotation angle deviation within the plane parallel to the nozzle surface 202 of the head module 210.

[Description of Adjustment of the Angular Deviation of the Rotation Direction]

Figure 6:
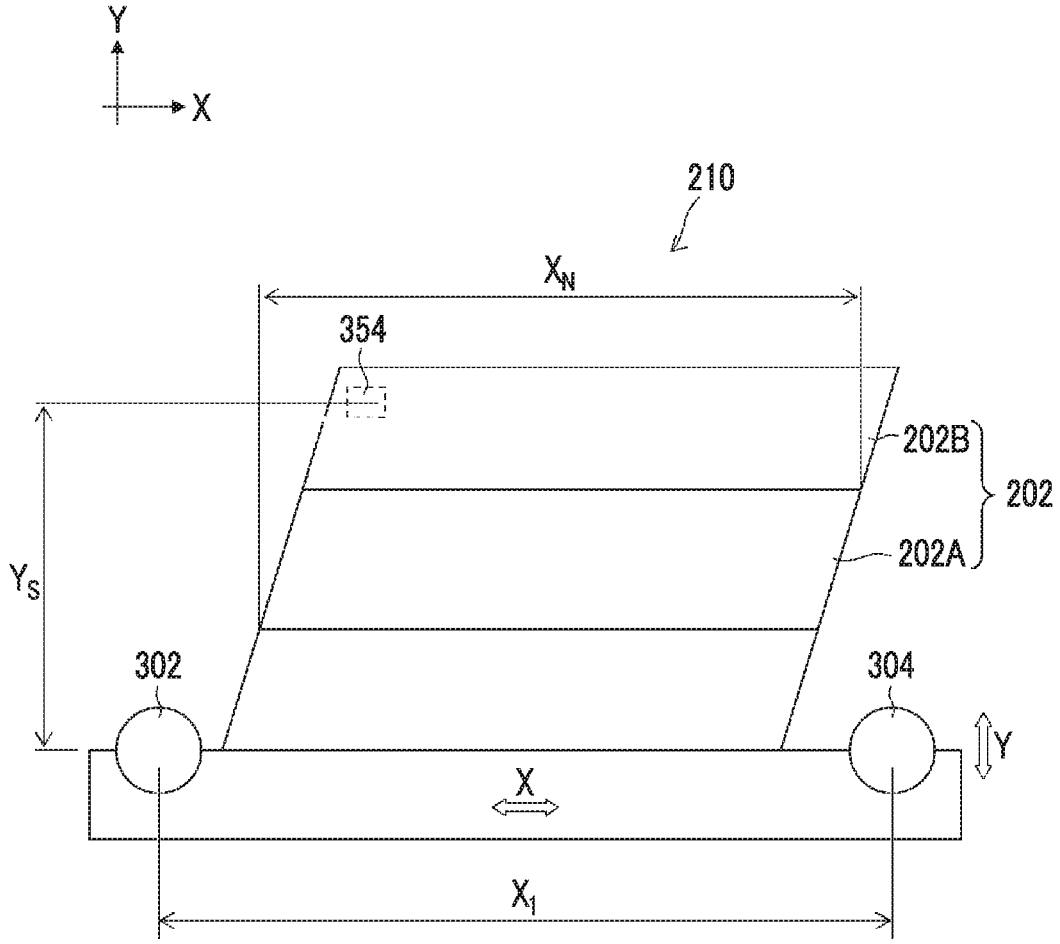
FIG. 6 is a schematic diagram of the adjustment of the angular deviation of the rotation direction.
Figure 7:
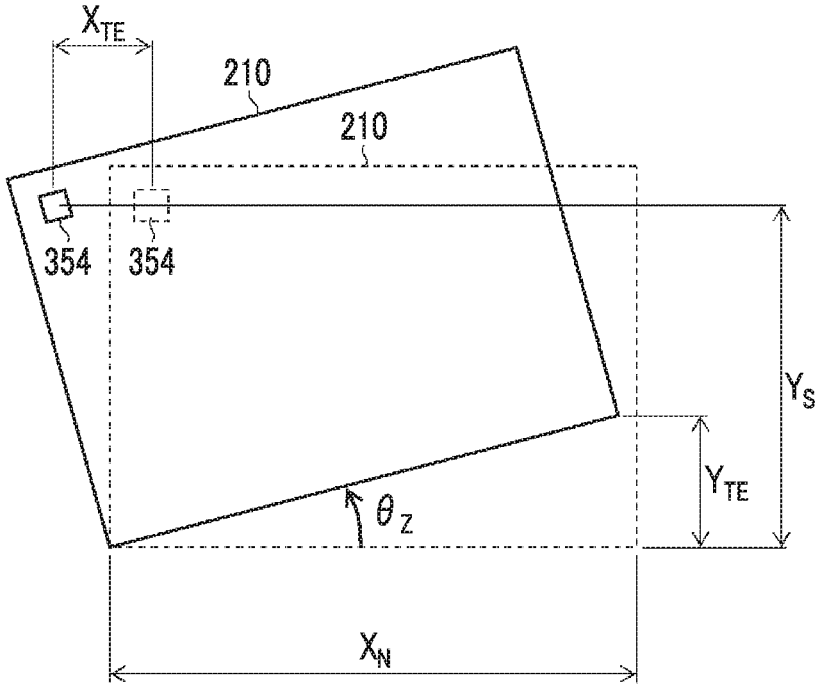
FIG. 7 is a schematic diagram of the adjustment of the angular deviation of the rotation direction.

FIGS. 6 and 7 are schematic diagrams of adjustment of the angular deviation of the rotation direction. FIGS. 6 and 7 are diagrams when the nozzle surface 202 is viewed from the side opposite to the nozzle surface 202. In FIG. 7, the head module 210 in a state in which angular deviation of the rotation direction has occurred is shown by the solid line, and the head module 210 in a state in which angular deviation of the rotation direction has not occurred is shown by the dotted line.

In FIGS. 6 and 7, the same or similar components as the components shown in FIG. 1 to FIGS. 5A and 5B are denoted by the same reference numerals, and the explanation thereof will be omitted. In FIG. 6, the detailed configuration of the rotation support mechanism 302 and the Y-direction moving mechanism 304 is not shown, and the simple configuration thereof is shown. In FIG. 7, for convenience of illustration, the planar shape of the head modules 210 is rectangular.

Reference numeral $X_1$ in FIG. 6 indicates an X-direction distance between the rotation support mechanism 302 and the Y-direction moving mechanism 304. The X-direction position of the rotation support mechanism 302 is assumed to be a contact point between the steel ball 312 and the base frame 212 shown in FIG. 2. The X-direction position of the Y-direction moving mechanism 304, that is, a position when moving the head module 210 to the Y direction in the adjustment of the angular deviation of the rotation direction is a contact point between the peripheral surface 338 of the cam portion 332 and the positioning pin 213 shown in FIGS. 5A and 5B.

Reference numeral $X_N$ in FIG. 6 is the total length of the nozzle arrangement region 202A in the X direction on the nozzle surface 202. The total length of the nozzle arrangement region 202A in the X direction is a distance between nozzles on both ends in the X direction.

Reference numeral $Y_s$ in FIG. 6 is a Y-direction distance between the rotation support mechanism 302 and the magnet 354. The position of the magnet 354 is assumed to be a position where the total length of the magnet 354 in the Y direction is bisected in the Y direction. The position of the magnet 354 is a detection position of the head module 210 detected by the position detection unit.

In the case of $X_1$=60 millimeters and $Y_S$=40 millimeters, when the head modules 210 is moved by 30 micrometers to the Y direction using the Y-direction moving mechanism 304, the X-direction movement distance of the magnet 354 that is the X-direction movement distance of the head module 210 detected by the position detection unit is 20 micrometers.

On the other hand, the Y-direction movement distance of the magnet 354, which is the Y-direction movement distance of the head module 210 detected by the position detection unit, is about 1/4000 of the X-direction movement distance.

The X-direction detection sensitivity and the Y-direction detection sensitivity of the position detection unit are substantially the same. In the case of moving the head module 210 to the Y direction using the Y-direction moving mechanism 304, the Y-direction movement distance of the head module 210 detected by the position detection unit is sufficiently smaller than the X-direction movement distance of the head module 210 detected by the position detection unit.

Accordingly, the head module 210 can be treated as being moved only to the X direction at the position detected by the position detection unit, that is, at the position where the magnet 354 is disposed.

In the adjustment of the angular deviation of the rotation direction of the head module 210 shown in the present embodiment, an angular deviation amount $\theta_Z$ of the rotation direction is derived, and an adjustment value $Y_{TE}$ of the Y-direction moving mechanism 304 corresponding to the angular deviation amount $\theta_Z$ is derived.

Then, a reference value $X_{TE}$ of the X-direction movement distance of the head module 210 detected by the position detection unit, which is required for the adjustment of the angular deviation of the rotation direction of the head module 210, is derived from the derived adjustment value $Y_{TE}$ of the Y-direction moving mechanism 304.

The adjustment value $Y_{TE}$ of the Y-direction moving mechanism 304 is a value obtained by multiplying the X-direction total length $X_N$ of the nozzle arrangement region 202A of the nozzle surface 202 by the angular deviation amount $\theta_Z$ of the rotation direction, and is expressed as $Y_{TE}=X_N\times\theta_Z$. The $X_{TE}$ of the X-direction movement distance of the head module 210 detected by the position detection unit when the head module 210 is moved only by the adjustment value $Y_{TE}$ to the Y-direction using the Y-direction moving mechanism 304 is a value obtained by dividing a value, which is obtained by multiplying $Y_S$ by $Y_{TE}$, by $X_N$, and is expressed as $X_{TE}=Y_S\times Y_{TE}/X_N$.

By adjusting the angular deviation of the rotation direction of the head module 210 by the Y-direction moving mechanism 304 while monitoring whether or not the position of the head module 210 detected by the position detection unit has moved by the reference value $X_{TE}$ to the X direction, it is possible to adjust the angular deviation of the rotation direction such that the angular deviation amount of the rotation direction of the head module 210 falls within the allowable range. That is, it is determined whether or not the adjustment of the angular deviation of the rotation direction of the head module 210 has been performed appropriately with the $X_{TE}$ as a reference value in the adjustment of the angular deviation of the rotation direction.

In order to monitor whether or not the X-direction position of the head module 210 detected by the position detection unit has moved by $X_{TE}$ to the X direction, it is possible to monitor the output of the position detection unit. For example, it is possible to output an output signal, which is proportional to the X-direction movement distance of the magnet 354, from the magnetic sensor 352 and sequentially turn on a plurality of LEDs according to the magnitude of the output signal. The LED is an abbreviation of a Light Emitting Diode.

In the present embodiment, an example is illustrated in which the magnet 354 functioning as a detection piece of the position detection unit is disposed at the X-direction end of the nozzle surface 202 on the rotation support mechanism 302 side and the Y-direction end of the nozzle surface 202 on the side opposite to the rotation direction adjusting unit 300.

The magnet 354 may be disposed at other positions. For example, the magnet 354 may be disposed at the center of the nozzle surface 202 in the X direction, or may be disposed at the center of the nozzle surface 202 in the Y direction. In accordance with the arrangement of the magnet 354, the magnetic sensor 352 is disposed at a position facing the magnet 354. Depending on the position of the magnet 354, the value of $X_N$ used in the derivation of the reference value $X_{TE}$ of the X-direction movement distance of the head module 210 detected by the position detection unit may be changed to the X-direction distance between the position of the magnet 354 and the Y-direction moving mechanism 304.

By increasing the Y-direction distance $Y_S$ between the rotation support mechanism 302 and the magnet 354, that is, by setting the position of the magnet 354 to a position distant from the rotation direction adjusting unit 300 for the Y direction, even in a case where the angular deviation amount $\theta_Z$ of the rotation direction of the head module 210 is a very small value, the X-direction movement distance of the head module 210 detected by the position detection unit can be made to become a larger value. Therefore, it is possible to improve the accuracy of adjustment of the angular deviation of the rotation direction of the head module 210.

Figure 8:
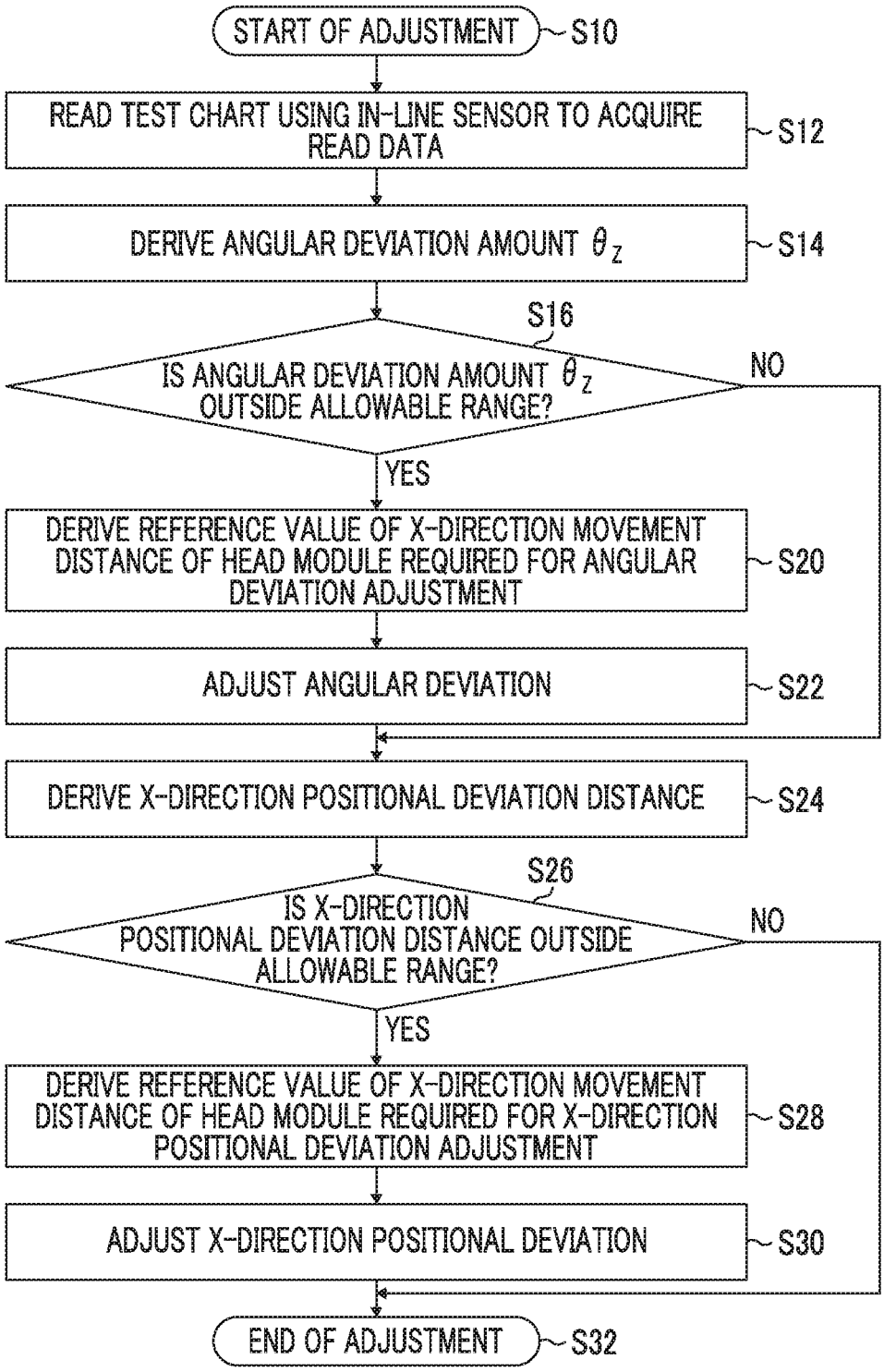
FIG. 8 is a flowchart of the adjustment of the angular deviation of the rotation direction.
Figure 9:
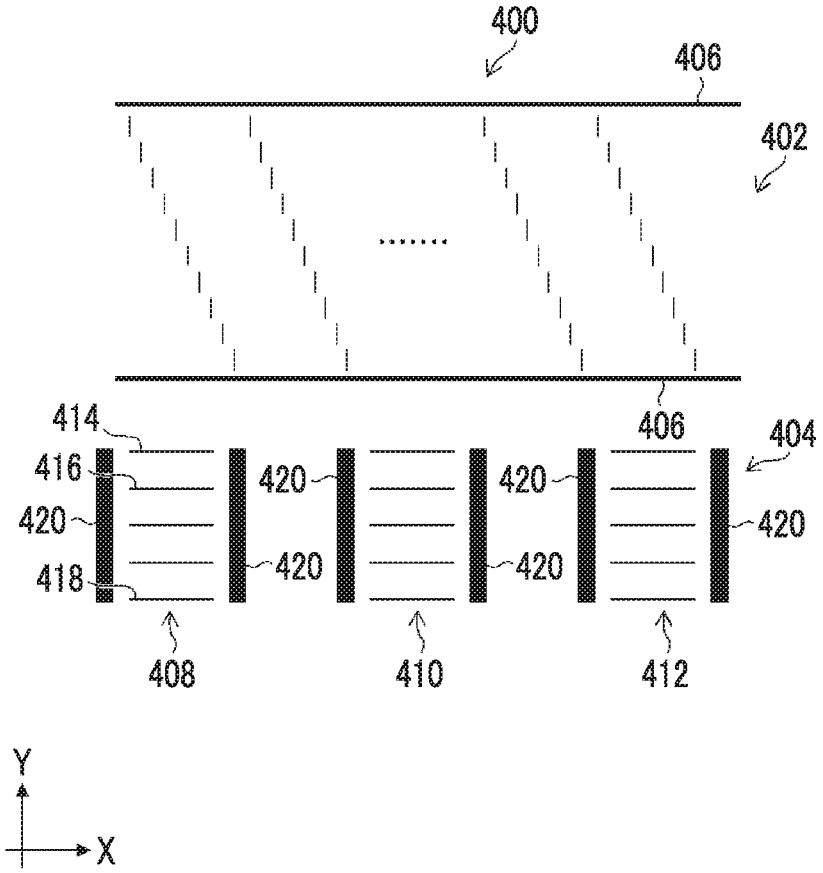
FIG. 9 is an explanatory diagram of a test chart.

FIG. 8 is a flowchart of the adjustment of the angular deviation of the rotation direction of the head module 210, which is a recording head adjusting method. When the adjustment is started in step S10, a test chart is formed using the head module 210 to be adjusted. In the read data acquisition step of step S12, reading of the test chart is performed, and the read data is acquired. Then, the process proceeds to step S14. FIG. 9 shows an example of the test chart.

In the case of an ink jet head assembled into an apparatus including an in-line sensor that functions as a reading unit, the reading of the test chart can be performed using the in-line sensor. By using the in-line sensor, it is possible to shorten the processing time from the reading of the test chart to the acquisition of the read data. In addition, it is not necessary to prepare a reader, such as a scanner device, outside the apparatus.

On the other hand, the reading of the test chart may be performed using a reader, such as a scanner device. This is effective in an apparatus that does not include an in-line sensor.

In the angular deviation amount deriving step of step S14, the angular deviation amount $\theta_Z$ of the rotation direction of the head module 210 is derived from the test chart reading result, and the process proceeds to step S16.

In the selection step of step S16, it is determined for each head module whether or not the angular deviation amount $\theta_Z$ of the head module 210 derived in the step of deriving the angular deviation amount of the rotation direction of step S14 is outside the allowable range, and a head module to be adjusted is selected. In the case of NO determination, that is, when the angular deviation amount $\theta_Z$ is within the allowable range in the selection step of step S16, the process of the head module 210 proceeds to step S24.

On the other hand, in the case of YES determination, that is, when the angular deviation amount $\theta_Z$ is outside the allowable range in the selection step of step S16, the process of the head module 210 proceeds to step S20.

In the X-direction movement distance reference value deriving step in the adjustment of angular deviation of the rotation direction of step S20, the adjustment value $Y_{TE}$ of the Y-direction moving mechanism 304 is derived from the angular deviation amount $\theta_Z$ of the head module 210 derived in the step of deriving the angular deviation of the rotation direction of step S14. Then, the reference value $X_{TE}$ of the X-direction movement distance of the head module 210 detected by the position detection unit, which is required for the adjustment of the angular deviation of the rotation direction, is derived from the derived Y-direction adjustment value $Y_{TE}$, and the process proceeds to step S22.

In the rotation direction angular deviation adjusting step of step S22, the angular deviation of the rotation direction of the head module 210 is adjusted using the Y-direction moving mechanism 304. The rotation direction angular deviation adjusting step includes a detection step of detecting the actual X-direction movement distance of the head module. In this step, the detected movement distance is compared with the reference value $X_{TE}$ of the movement distance. When the detected movement distance is within an adjustment range determined in advance for the reference value $X_{TE}$ of the movement distance, it is determined that the rotation direction angular deviation adjusting step has been performed appropriately. The rotation direction angular deviation adjusting step is performed until the detected movement distance falls within the adjustment range determined in advance for the reference value $X_{TE}$ of the movement distance. The rotation direction angular deviation adjusting step corresponds to a rotation direction adjusting step. The reference value $X_{TE}$ of the movement distance can be determined from image quality. In the case of high-quality image recording, the reference value $X_{TE}$ of the movement distance can be any value within a range of 1 micrometer or more and 10 micrometers or less, for example, 5 micrometers.

When the angular deviation of the rotation direction of the head module 210 has been adjusted through the steps S10 to S22, X-direction positional deviation adjustment including steps S24 to S30 is performed.

In the X-direction positional deviation distance deriving step of step S24, the X-direction positional deviation distance of the head module 210 to be adjusted is derived, and the process proceeds to step S26.

In the determination step of step S26, it is determined whether or not the X-direction positional deviation distance of the head module 210 derived in step S24 is outside the allowable range. In the case of NO determination indicating that the derived X-direction positional deviation distance of the head module 210 is within the allowable range, the process proceeds to step S32.

On the other hand, in the case of YES determination, which indicates that the X-direction positional deviation distance of the head module 210 derived in the X-direction positional deviation distance deriving step of step S24 is outside the allowable range, in the determination step of step S26, the process proceeds to step S28.

In the X-direction movement distance reference value deriving step in the X-direction positional deviation adjustment of step S28, the adjustment value of the X-direction position adjusting unit is derived, and the reference value of the X-direction movement distance of the head module 210 detected by the position detection unit is derived. Then, the process proceeds to step S30. The X-direction position adjusting unit that functions as a first direction position adjusting unit is denoted by reference numeral 249 in FIG. 12, and will be described in detail later.

In the X-direction positional deviation adjusting step of step S30, the X-direction positional deviation of the head module 210 is adjusted using the X-direction position adjusting unit. The X-direction positional deviation adjusting step includes a detection step of detecting the actual X-direction movement distance of the head module 210. In this step, it is determined whether or not the X-direction positional deviation adjustment step has been performed appropriately by comparing the detected movement distance with the reference value. The X-direction positional deviation adjusting step corresponds to a first direction position adjusting step.

When the X-direction positional deviation has been adjusted by adjusting the angular deviation of the rotation direction of the head module 210, the process proceeds to step S32 to end the adjustment of the head module 210 to be adjusted.

A configuration is also possible in which a step of forming a test chart, a step of acquiring the reading information of the test chart, and a step of determining whether or not the angular deviation of the rotation direction and the positional deviation in the X direction are outside the allowable range are included after adjusting the X-direction positional deviation by adjusting the angular deviation of the rotation direction of the head module 210 and re-adjustment is performed in a case where at least one of the angular deviation of the rotation direction or the X-direction positional deviation is outside the allowable range.

In the present embodiment, an example is illustrated in which adjustment of the head module 210 is performed in order of adjustment of the angular deviation of the rotation direction and adjustment of the X-direction positional deviation. However, it is also possible to change the order of the adjustment of the angular deviation of the rotation direction and the adjustment of the X-direction positional deviation.

The ink jet head 200, for example, the base frame 212 can also be made to include a display unit to display whether or not adjustment has been performed appropriately, which can be used in the step of adjusting the angular deviation of the rotation direction of the head module 210 of step S22.

The ink jet head 200, for example, the base frame 212 can also be made to include a display unit to display whether or not adjustment has been performed appropriately, which can be used in the step of adjusting the X-direction positional deviation of the head module 210 of step S30.

FIG. 9 is an explanatory diagram showing an example of the test chart used in the derivation of an adjustment value in the adjustment of the angular deviation of the rotation direction of the head module 210 and an adjustment value in the X-direction positional deviation adjustment. A test chart 400 shown in FIG. 9 is configured to include a pattern image for recording position detection 402 and a pattern image for rotation direction adjustment 404.

A 1-ON N-OFF pattern is applied to the pattern image for recording position detection 402. The 1-ON N-OFF pattern is used to detect the recording position of each nozzle. In the X-direction positional deviation adjustment, data of recording positions of nozzles at both X-direction ends of each head module 210 is used, and the X-direction positional deviation distance of each head module 210 is derived from the relative position in the X direction with respect to the adjacent head module 210. The 1-ON N-OFF pattern is formed by the following processing.

Ink is jetted every N nozzles, in a projected nozzle group obtained by projecting all nozzles of the ink jet head 200 in the X direction, to form a pattern image of one stage. After the pattern image of one stage is formed, nozzles through which ink is to be jetted are switched to form a pattern image of the next stage. By repeating the processing, pattern images of N+1 stages are formed using all nozzles.

Between the pattern image for recording position detection 402 and the pattern image for rotation direction adjustment 404, a boundary pattern image 406 showing the boundary between the pattern image for recording position detection 402 and the pattern image for rotation direction adjustment 404 is formed.

In the example shown in FIG. 9, the boundary pattern image 406 is also formed on the side of the pattern image for recording position detection 402 not facing the pattern image for rotation direction adjustment 404. The pattern image for rotation direction adjustment 404 is configured to include three pattern images 408, 410, and 412 for one head module 210.

The first pattern image 408 is formed corresponding to the one end of the head module 210 in the X direction, the second pattern image 410 is formed corresponding to the center of the head module 210 in the X direction, and the third pattern image 412 is formed the other end of the head module 210 in the X direction.

Since the same configuration is applied to the first pattern image 408, the second pattern image 410, and the third pattern image 412, the first pattern image 408 will be described as a representative of the first pattern image 408, the second pattern image 410, and the third pattern image 412.

In the first pattern image 408, a first linear dot group 414 along the X direction is formed by jetting ink from nozzles corresponding to the formation position of the first pattern image 408 in the projected nozzle group obtained by projecting all nozzles of the ink jet head 200 in the X direction.

After the passage of predetermined time, a second dot group 416 is formed by jetting ink from nozzles corresponding to the formation position of the first pattern image 408. Thereafter, the processing is repeated until the last dot group 418 is formed.

A pattern image denoted by reference numeral 420 is disposed at both X-direction ends for recognizing each boundary between two of the first pattern image 408, the second pattern image 410, and the third pattern image 412.

The Y-direction positions of a plurality of dot groups 414, 416, and 418 formed in this manner are measured. When angular deviation of the rotation direction of the head module 210 occurs, Y-direction positions of the dot groups 414, Y-direction positions of the dot groups 416, and Y-direction positions of the dot groups 418 are different between the first pattern image 408 and the second pattern image 410.

That is, in a case where the Y-direction positions of the first pattern image 408, the second pattern image 410, and the third pattern image 412 are different, it can be determined that angular deviation of the rotation direction has occurred in the head module 210, and it is possible to derive the angular deviation amount $\theta_Z$ of the rotation direction of the head module 210.

In this example, the pattern image for rotation direction adjustment 404 configured to include three pattern images is exemplified. However, the pattern image for rotation direction adjustment 404 is not limited to the example shown in FIG. 9 as long as the angular deviation amount $\theta_Z$ in the rotation direction of the head module 210 can be derived. For example, it is possible to use an image in which the second pattern image 410 is omitted or an image in which the three pattern images are integrally formed.

When deriving the angular deviation amount $\theta_Z$ of the rotation direction of the head module 210, by forming the pattern image for rotation direction adjustment 404 using nozzles at both ends in the X direction, it is possible to derive the angular deviation amount $\theta_Z$ of the rotation direction of the head module 210 even if the angular deviation amount $\theta_Z$ of the rotation direction of the head module 210 is very small.

[Configuration of a Position Detection Unit]

Figure 11:
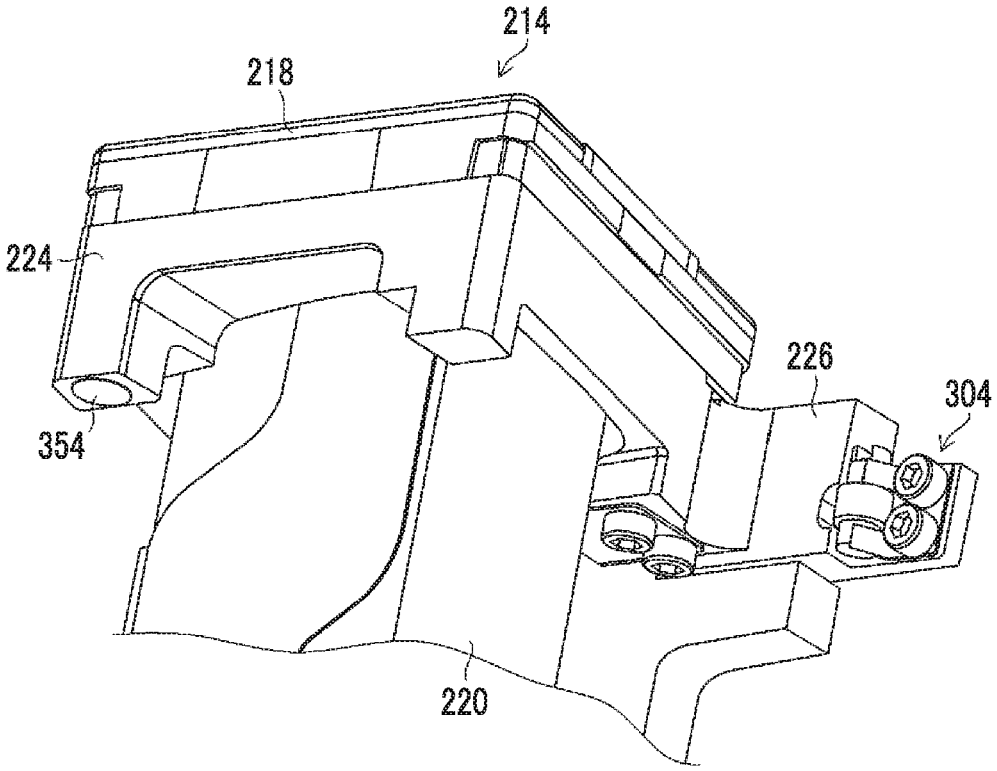
FIG. 11 is a perspective view showing an example of the mounting position of a magnet.

FIG. 10 is an explanatory diagram showing an example of the arrangement of the magnetic sensor 352 and the magnet 354. FIG. 11 is a perspective view showing an example of the mounting position of the magnet 354. In FIGS. 10 and 11, the above-described components are denoted by the same reference numerals, and the explanation thereof will be omitted. Some of the reference numerals of the above-described components are omitted.

The position detection unit 350 is configured to include the magnetic sensor 352 and the magnet 354. The magnetic sensor 352 has a structure in which a hall element 356 is mounted on a substrate 358. On the substrate 358, an output terminal from which an output signal of the hall element 356 is output is mounted. In FIG. 10, illustration of the output terminal is omitted.

The magnet 354 that functions as a detection piece detected by the magnetic sensor 352 is attached to the horizontal portion 224 of the bracket 216. Specifically, the magnet 354 is disposed at a position of the horizontal portion 224 corresponding to the rotation support mechanism 302 in the X direction, and is attached to the end on the side opposite to the rotation support mechanism 302 that is the other end in the Y direction. In addition, the magnet 354 is attached to the surface of the horizontal portion 224 facing the base frame 212.

When the head module 210 is attached to the base frame 212, the magnetic sensor 352 and the magnet 354 face each other. Based on the output signal from the magnetic sensor 352, it is possible to check the relative position of the head module 210 in the X direction with the base frame 212 as a reference.

A detection signal acquired by the position detection unit 350 can be taken out from an output terminal (not shown) through the electrical wiring, and is used to detect the X-direction position and the X-direction movement distance of the head module 210.

Although an example in which the magnet 354 is disposed in the head module 210 and the magnetic sensor 352 is disposed on the base frame 212 is illustrated in the present embodiment, a configuration is also possible in which a magnetic sensor is disposed in the head module 210 and the magnet 354 is disposed on the base frame 212.

In the present embodiment, an example is illustrated in which the magnetic sensor 352 is applied as a sensor of the position detection unit 350. However, other types of sensors, such as an optical sensor, may be applied instead of the magnetic sensor 352.

[Description of a Head Module]

Figure 12:
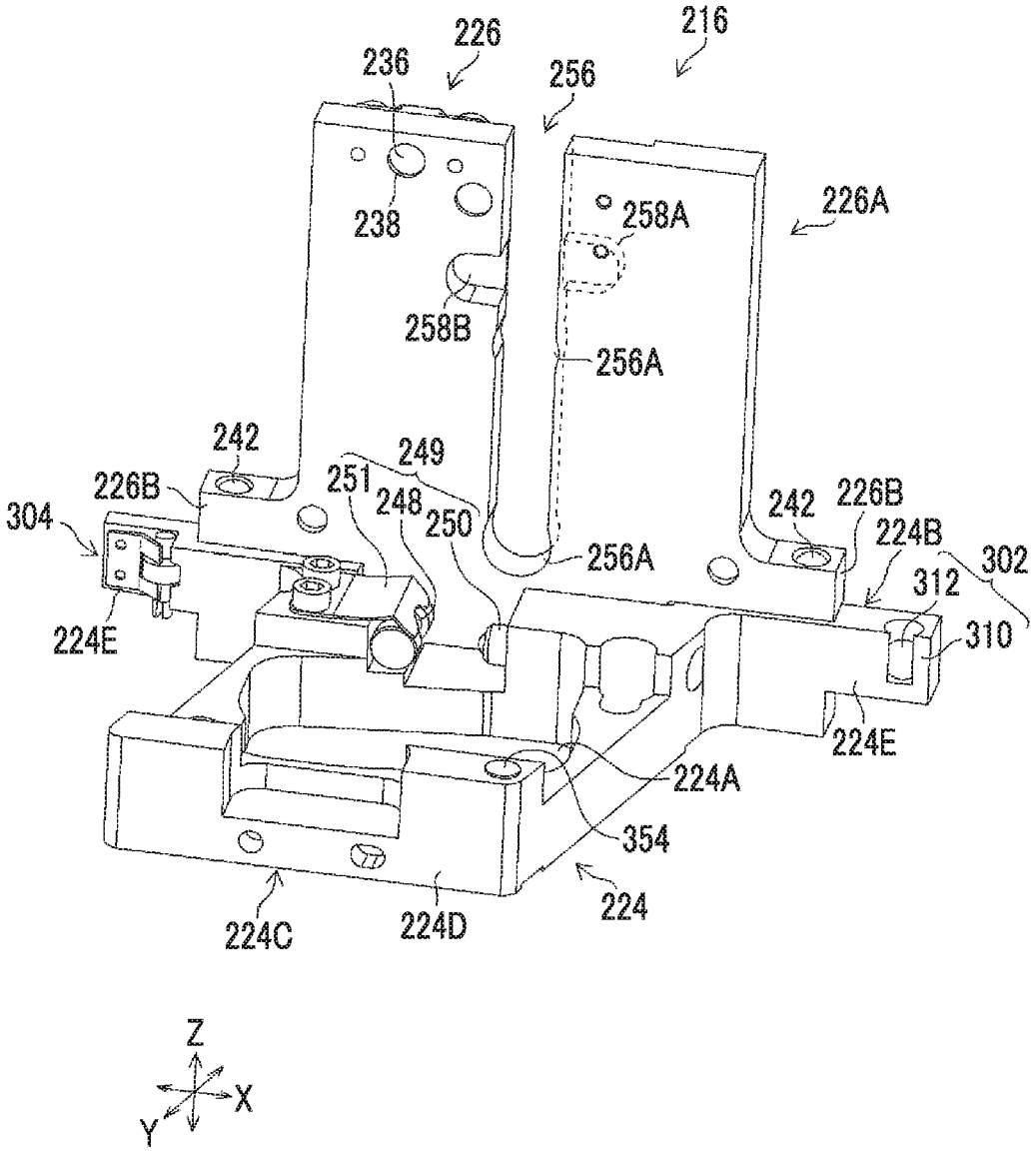
FIG. 12 is a perspective view when viewed from the rear surface side of a bracket.
Figure 13:
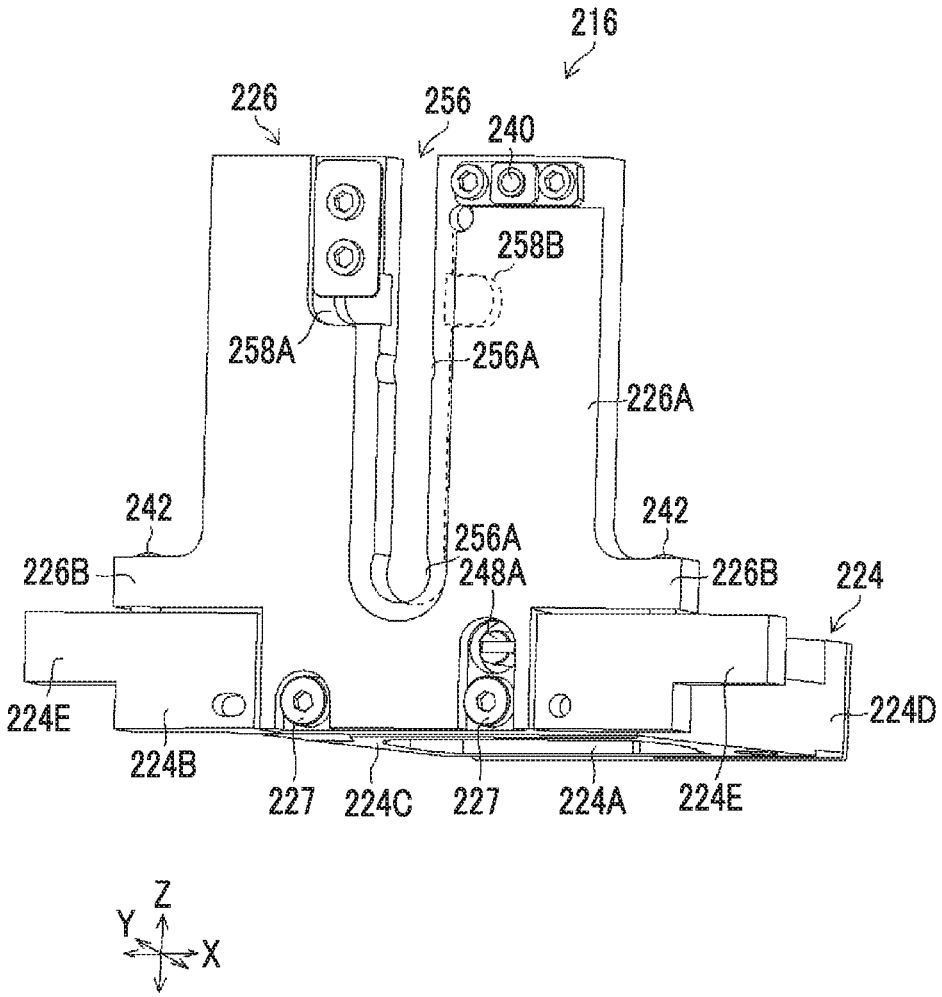
FIG. 13 is a perspective view when viewed from the opposite side of the rear surface of the bracket.

FIGS. 12 and 13 are perspective views of the bracket 216 that forms the head module 210. FIG. 12 is a diagram when viewed from the rear surface side to which the head unit 214 shown in FIG. 2 is attached, and FIG. 13 is a diagram when viewed from the opposite side of the rear surface side to which the head unit 214 shown in FIG. 2 is attached. In FIGS. 12 and 13, illustration of the head unit 214 is omitted.

The bracket 216 is configured to include the horizontal portion 224 and the vertical portion 226, and has a structure in which the vertical portion 226 is vertically fixed to a first surface 224B of the horizontal portion 224 using a screw 227 shown in FIG. 13 so that the horizontal portion 224 and the vertical portion 226 are unified.

The term for "vertical" in this specification includes a case capable of obtaining the same effect as in a case where two directions cross each other substantially at an angle of 90°, in a case in which two directions cross each other at an angle less than 90° or a case in which two directions cross each other at an angle exceeding 90°.

The horizontal portion 224 is configured to include a plate-shaped member. The horizontal portion 224 is configured to include a horizontal portion body 224D and a pair of horizontal protruding portions 224E formed by X-direction overhanging from both sides of the horizontal portion body 224D.

The vertical portion 226 is fixed to the horizontal portion body 224D, and the main body portion 218 of the head unit 214 shown in FIG. 2 is supported by the horizontal portion body 224D. Referring back to FIGS. 12 and 13, an opening 224A shown in FIGS. 12 and 13, which has a shape and area allowing the electrical and piping portion 220 of the head unit 214 shown in FIG. 2 to pass therethrough, is provided in the horizontal portion body 224D.

As shown in FIG. 12, the rotation support mechanism 302 including the housing 310 in which the steel ball 312 is fixed and held is provided in one of the horizontal protruding portions 224E. The Y-direction moving mechanism 304 is provided in the other horizontal protruding portion 224E. In FIG. 12, illustration of the reference numeral of the configuration of the Y-direction moving mechanism 304 is omitted.

Figure 14:
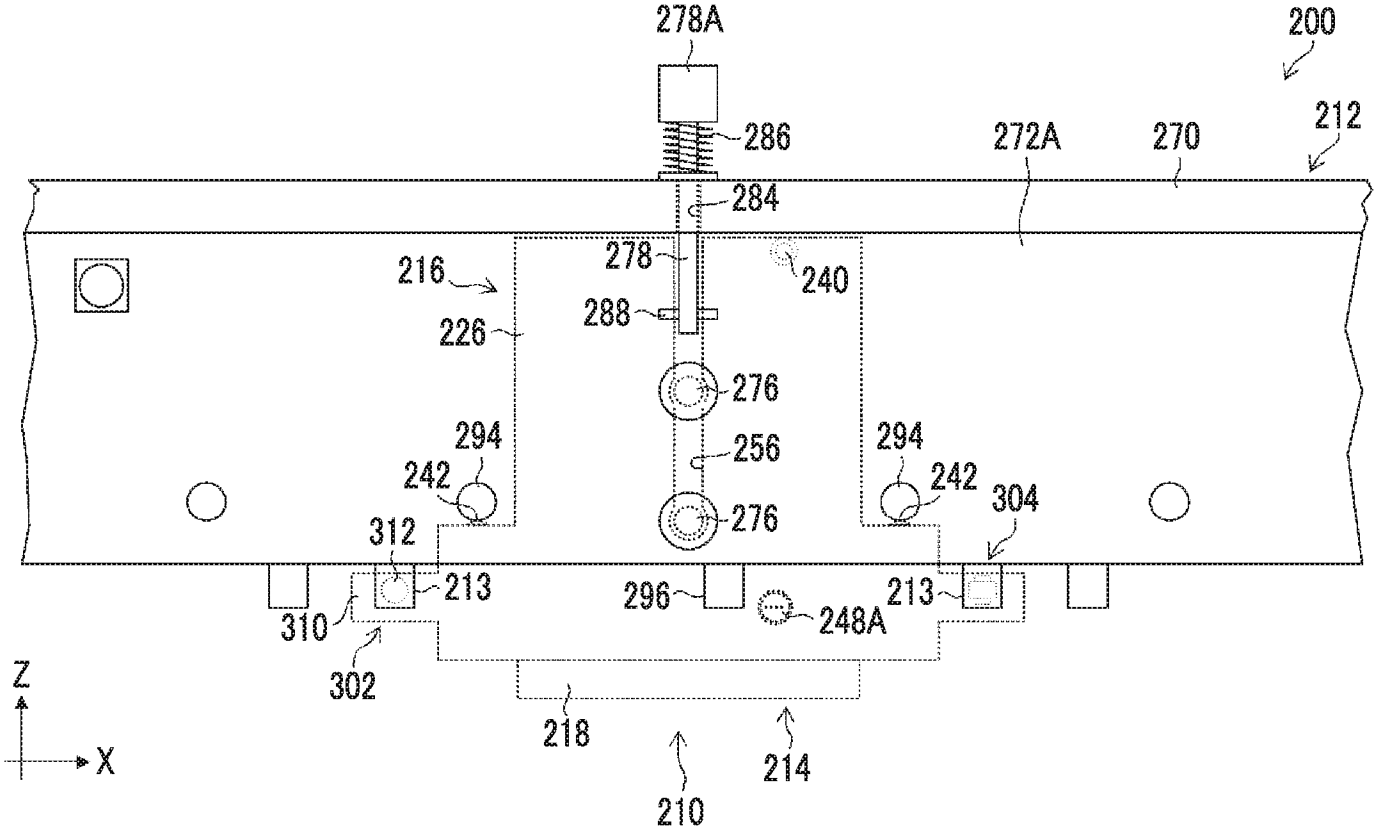
FIG. 14 is a front view of a base frame.

When the head unit 214 shown in FIG. 2 is attached to the bracket 216, the periphery of the surface of the main body portion 218 of the head unit 214 on the side opposite to the nozzle surface 202 is supported by a second surface 224C of the horizontal portion 224 shown in FIGS. 12 and 13. FIG. 14 shows a state in which the head unit 214 is attached to the bracket 216.

As shown in FIGS. 12 and 13, the vertical portion 226 is configured to include a plate-shaped member. The vertical portion 226 is configured to include a vertical portion body 226A and a pair of protruding portions 226B formed by X-direction overhanging from both sides of the vertical portion body 226A.

A pair of head module Z-direction contact members 242 are provided in a pair of protruding portions 226B.

A pair of head module Z-direction contact members 242 are used in the adjustment of the Z-direction position of the head module 210 with respect to the base frame 212 shown in FIG. 14. By adjusting the amount of protrusion from the protruding portion 226B of the head module Z-direction contact member 242, the Z-direction position of the head module 210 with respect to the base frame 212 is adjusted.

The head module Z-direction contact member 242 is in contact with a base frame Z-direction contact member 294 provided in the base frame 212 in a state in which the head module 210 is attached to the base frame 212, so that the head module 210 is positioned in the Z direction with respect to the base frame 212.

Referring back to FIG. 12, the horizontal portion 224 includes an eccentric roller 248 and a plunger 250 that are components of the X-direction position adjusting unit 249 that adjusts the X-direction position of the head module 210 with respect to the base frame 212.

The eccentric roller 248 has a shape in which the diameter of an eccentric portion, which is a central portion in the axial direction, is less than the diameter of a support portion, which is both ends in the axial direction. In the eccentric roller 248, the support portion is supported by two support surfaces of the horizontal portion body 224D.

A plate spring 251 has a structure for biasing the eccentric roller 248 from the opposite side of the two support surfaces. By bringing the plate spring 251 into contact with the support portion of the eccentric roller 248 in a state in which the plate spring 251 is bent, the eccentric roller 248 is biased by the plate spring 251 against the two support surfaces.

In the plate spring 251, a cutout portion is formed corresponding to the contact position between the eccentric roller 248 and an X-direction positioning reference pin 296 shown in FIG. 14. Due to the cutout portion of the plate spring 251, contact between the plate spring 251 and the X-direction positioning reference pin 296 is avoided.

The plunger 250 is supported by the horizontal portion body 224D. The eccentric roller 248 and the plunger 250 are disposed so as to face each other with a predetermined distance therebetween.

If the eccentric roller 248 is rotated by rotating a groove 248A shown in FIG. 13, the X-direction positioning reference pin 296 inserted between the eccentric portion and the plunger 250 can be moved. Therefore, it is possible to adjust the X-direction position of the head module 210 with respect to the base frame 212. The X-direction positioning reference pin 296 is denoted by reference numeral 296 in FIG. 14.

Referring back to FIGS. 12 and 13, a guide groove 256 for attaching the bracket 216 to the base frame 212 is formed in the vertical portion 226 of the bracket 216. The guide groove 256 is formed in the vertical portion body 226A of the vertical portion 226, and is formed along the Z direction.

A pair of Y-direction guide posts 276 provided on the base frame 212 side are fitted into the guide groove 256 when attaching the bracket 216 to the base frame 212 shown in FIG. 14.

The width of the guide groove 256 is set to be almost the same as the diameter of the Y-direction guide post 276. Therefore, it is possible to prevent interference with the adjacent head module 210.

Referring back to FIGS. 12 and 13, the guide groove 256 includes an arc-shaped enlarged diameter portion 256A that is formed at the lower end and the center in the Z direction. When the head module 210 shown in FIG. 14 is attached to the base frame 212, a pair of Y-direction guide posts 276 provided on the base frame 212 side are housed in the enlarged diameter portion 256A.

Therefore, the head module 210 attached to the base frame 212 is movably supported in the X direction.

Since the enlarged diameter portion 256A of the guide groove 256 is provided in order to movably support the head module 210 in the X direction, the formation position is set corresponding to the Y-direction guide post 276. Accordingly, the enlarged diameter portion 256A of the guide groove 256 is formed such that the Y-direction guide post 276 is housed at the center position of the guide groove 256 in the Z direction when the head module 210 is attached to the base frame 212.

Here, when the head module 210 is attached to the base frame 212, the enlarged diameter portion 256A is formed so as to form a circle having the axis of the Y-direction guide post 276 as its center. The diameter of the circle is larger than the diameter of the Y-direction guide post 276.

Accordingly, when the head module 210 is attached to the base frame 212, the head module 210 can be movably supported within the range of the diameter of the enlarged diameter portion 256A. In addition, it is possible to attach the head module 210 to the base frame 212 without causing a backlash in the head module 210 when attaching the head module 210 to the base frame 212.

Referring back to FIGS. 12 and 13, a pair of cutout portions 258A and 258B are formed on the inner wall surface of the guide groove 256. A locking bar 288 of a Z-direction hanging rod 278 provided on the base frame 212 side is engaged with a pair of cutout portions 258A and 258B when attaching the bracket 216 to the base frame 212 shown in FIG. 14.

Figure 15:
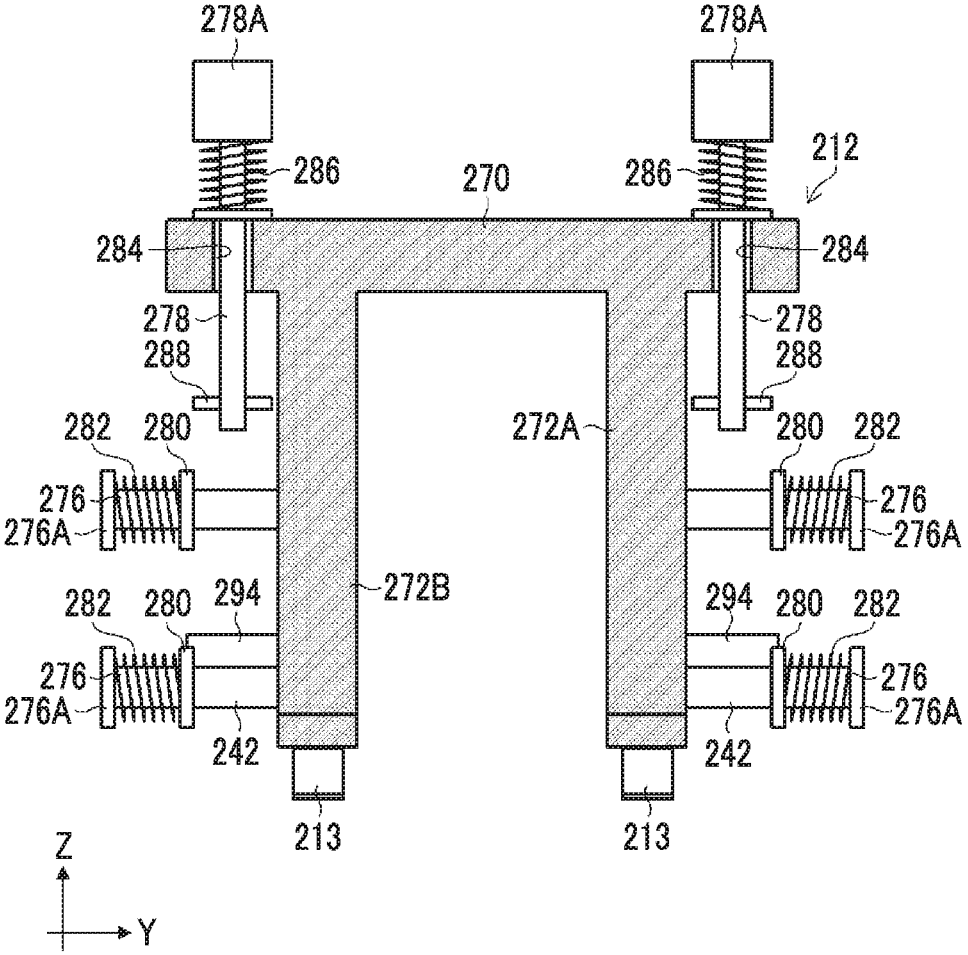
FIG. 15 is a side surface cross-sectional view of the base frame.

FIGS. 14 and 15 show the Z-direction hanging rod 278 and the locking bar 288 of the Z-direction hanging rod 278.

Referring back to FIGS. 12 and 13, the bracket 216 is locked to the base frame 212 when the locking bar 288 of the Z-direction hanging rod 278 shown in FIG. 14 is engaged with the cutout portions 258A and 258B. The cutout portions 258A and 258B shown in FIGS. 12 and 13 are formed at the opposite positions of the inner wall surface of the guide groove 256, and are formed with a predetermined depth on the inner surface side and the outer surface side of the vertical portion 226 of the bracket 216, respectively. That is, one cutout portion 258A is formed on the outer surface side of the vertical portion 226, and the other cutout portion 258B is formed on the inner surface side.

A head module Y-direction movable contact member insertion hole 238 into which a head module Y-direction movable contact member 236 is inserted is provided in the vertical portion body 226A of the vertical portion 226 of the bracket 216, and a head module Y-direction movable contact member position adjusting screw 240 shown in FIG. 13, which is for adjusting the amount of protrusion of the head module Y-direction movable contact member 236, is inserted into the head module Y-direction movable contact member insertion hole 238.

The head module Y-direction movable contact member 236 and the head module Y-direction movable contact member insertion hole 238 shown in FIG. 12 and the head module Y-direction movable contact member position adjusting screw 240 shown in FIG. 13 are components of the Y-direction position adjusting unit.

[Description of a Base Frame]

FIG. 14 is a front view of a base frame showing the schematic configuration of the base frame. FIG. 15 is a side surface cross-sectional view of the base frame.

The base frame 212 that forms the ink jet head 200 is configured to include an upper frame portion 270 and a pair of lower frame portions 272A and 272B, and has a structure in which a pair of lower frame portions 272A and 272B are vertically bonded to the upper frame portion 270.

The head module 210 shown by the dotted line in FIG. 14 is alternately attached to a pair of lower frame portions 272A and 272B.

Assuming that one lower frame portion 272A is a first lower frame portion and the other lower frame portion 272B is a second lower frame portion, the first head module 210 is attached to the first lower frame portion 272A and the second head module 210 disposed next to the first head module 210 is attached to the second lower frame portion 272B.

In addition, the third head module 210 disposed next to the second head module 210 is attached to the first lower frame portion 272A, and the fourth head module disposed next to the third head module 210 is attached to the second lower frame portion 272B. The head module 210 is alternately attached to the first lower frame portion 272A and the second lower frame portion 272B.

A head module support structure for supporting the head module 210 is provided in the base frame 212. The head module support structure is prepared for each head module.

The head module support structure is alternately provided in a pair of lower frame portions 272A and 272B. The installation interval of the head module support structure in the X direction matches the installation interval of the head module 210, which is attached to a pair of lower frame portions 272A and 272B, in the X direction.

As shown in FIG. 15, the head module support structure is configured to include a pair of Y-direction guide posts 276 and the Z-direction hanging rod 278. A pair of Y-direction guide posts 276 are disposed in parallel with a predetermined interval in the Z direction.

The Y-direction guide post 276 has a flange portion 276A at the top, and is provided so as to protrude from the outer surfaces of a pair of lower frame portions 272A and 272B. The diameter of the Y-direction guide post 276 is set to be almost the same as the width of the guide groove 256 shown in FIG. 14.

When attaching the head module 210 to the base frame 212, the guide groove 256 formed in the vertical portion 226 of the bracket 216 shown by the dotted line in FIG. 14 is fitted into a pair of Y-direction guide posts 276.

Since the diameter of the Y-direction guide post 276 is almost the same as the width of the guide groove 256, the head module 210 can be attached to the base frame 212 so as to be in close contact therewith when attaching the head module 210 to the base frame 212.

As shown in FIG. 15, the Y-direction guide post 276 includes a Y-direction pressing plate 280. The Y-direction pressing plate 280 is formed in a ring shape. The Y-direction guide post 276 is inserted into a ring-shaped inner peripheral portion of the Y-direction pressing plate 280. As a result, the Y-direction pressing plate 280 is provided in the Y-direction guide post 276.

The Y-direction guide post 276 includes a Y-direction pressing spring 282 as Y-direction biasing means. The Y-direction guide post 276 is inserted into an inner peripheral portion of the Y-direction pressing spring 282. As a result, the Y-direction pressing spring 282 is provided in the Y-direction guide post 276.

The Y-direction pressing spring 282 is disposed between the flange portion 276A of the Y-direction guide post 276 and the Y-direction pressing plate 280.

Referring back to FIG. 14, when attaching the head module 210 to the base frame 212, the Y-direction guide post 276 is fitted into the guide groove 256 of the head module 210. When the Y-direction guide post 276 is fitted into the guide groove 256, the Y-direction pressing plate 280 is engaged with the vertical portion 226 of the bracket 216.

Since the Y-direction pressing plate 280 is biased in the Y direction by the Y-direction pressing spring 282, the head module 210 is pressed against the base frame 212 by the Y-direction pressing plate 280.

The Z-direction hanging rod 278 has a knob portion 278A at the top. The Z-direction hanging rod 278 is disposed in parallel to the Z direction. A Z-direction hanging rod insertion hole 284 to which the Z-direction hanging rod 278 is attached is formed in the upper frame portion 270.

The Z-direction hanging rod insertion hole 284 is formed along the Z direction, and is formed so as to pass through the upper frame portion 270. The Z-direction hanging rod 278 is inserted into the Z-direction hanging rod insertion hole 284, thereby being attached to the upper frame portion 270.

The Z-direction hanging rod 278 attached to the upper frame portion 270 is disposed in front of the outer surfaces of a pair of lower frame portions 272A and 272B. The outer surfaces of a pair of lower frame portions 272A and 272B are surfaces on the opposite side of the surfaces of a pair of lower frame portions 272A and 272B to which the head module 210 is attached.

The Z-direction hanging rod 278 and a pair of the Y-direction guide post 276 are disposed on the same straight line, and the Z-direction hanging rod 278 is disposed above a pair of Y-direction guide posts 276. As shown in FIG. 14, when the head module 210 is attached to the base frame 212, the Z-direction hanging rod 278 is housed in the guide groove 256 of the head module 210.

Referring back to FIG. 15, the Z-direction hanging rod 278 includes a Z-direction pressing spring 286. The Z-direction hanging rod 278 is inserted into an inner peripheral portion of the Z-direction pressing spring 286. As a result, the Z-direction pressing spring 286 is provided in the Z-direction hanging rod 278.

The Z-direction pressing spring 286 is provided between the knob portion 278A of the Z-direction hanging rod 278 and the upper frame portion 270. The Z-direction hanging rod 278 is biased in a direction in which the Z-direction hanging rod 278 is pulled up toward the upper frame portion 270 by the biasing force of the Z-direction pressing spring 286.

The Z-direction hanging rod 278 includes the locking bar 288 at the lower end. The locking bar 288 is provided so as to protrude to the left and right sides from the lower end of the Z-direction hanging rod 278. In other words, the locking bar 288 is provided so as to be perpendicular to the axial direction of the Z-direction hanging rod 278.

The locking bar 288 is formed so as to be longer than the width of the guide groove 256 of the head module 210. As shown in FIG. 14, the locking bar 288 is fitted into the cutout portions 258A and 258B formed in the guide groove 256 of the head module 210, thereby locking the head module 210.

The insertion of the locking bar 288 into the cutout portions 258A and 258B is performed by rotating the Z-direction hanging rod 278. If the head module 210 is attached to the base frame 212 in a state in which the locking bar 288 is toward the X direction, it is not possible to attach the head module 210 since the locking bar 288 is brought into contact with an inlet portion of the guide groove 256.

When attaching the head module 210 to the base frame 212, the locking bar 288 is located at a position where the locking bar 288 is not in contact with the inner wall of the guide groove 256, and the head module 210 is attached to the base frame 212.

When the head module 210 is attached to the base frame 212 and the locking bar 288 is located at the formation positions of the cutout portions 258A and 258B, the Z-direction hanging rod 278 is rotated so that the locking bar 288 is fitted into the cutout portions 258A and 258B.

The position of the locking bar 288 in a state in which the locking bar 288 is fitted into the cutout portions 258A and 258B by making the axial direction of the locking bar 288 parallel to the X direction is assumed to be a lock position.

On the other hand, the position of the locking bar 288 in a state in which the locking bar 288 deviates from the cutout portions 258A and 258B since the locking bar 288 is not in contact with the inner wall of the guide groove 256 by making the axial direction of the locking bar 288 perpendicular to the X direction is assumed to be an unlock position.

The Z-direction hanging rod 278 is biased upward by the Z-direction pressing spring 286. Accordingly, when the locking bar 288 is fitted into the cutout portions 258A and 258B, the locking bar 288 is engaged with the cutout portions 258A and 258B. When the locking bar 288 is engaged with the ceiling surface of the inner peripheral portion of the cutout portions 258A and 258B, the head module 210 attached to the base frame 212 is biased upward.

The base frame 212 and the head module 210 include the X-direction position adjusting unit 249, a Y-direction position adjusting unit, and a Z-direction position adjusting unit that adjust the position of the head module 210 with respect to the base frame 212. Illustration of the reference numerals of the Y-direction position adjusting unit and the Z-direction position adjusting unit is omitted.

The X-direction position adjusting unit 249 adjusts the X-direction position of the head module 210 with respect to the base frame 212. The X-direction position adjusting unit includes the eccentric roller 248 and the plunger 250 shown in FIG. 12 and the X-direction positioning reference pin 296 shown in FIG. 14.

Figure 18:
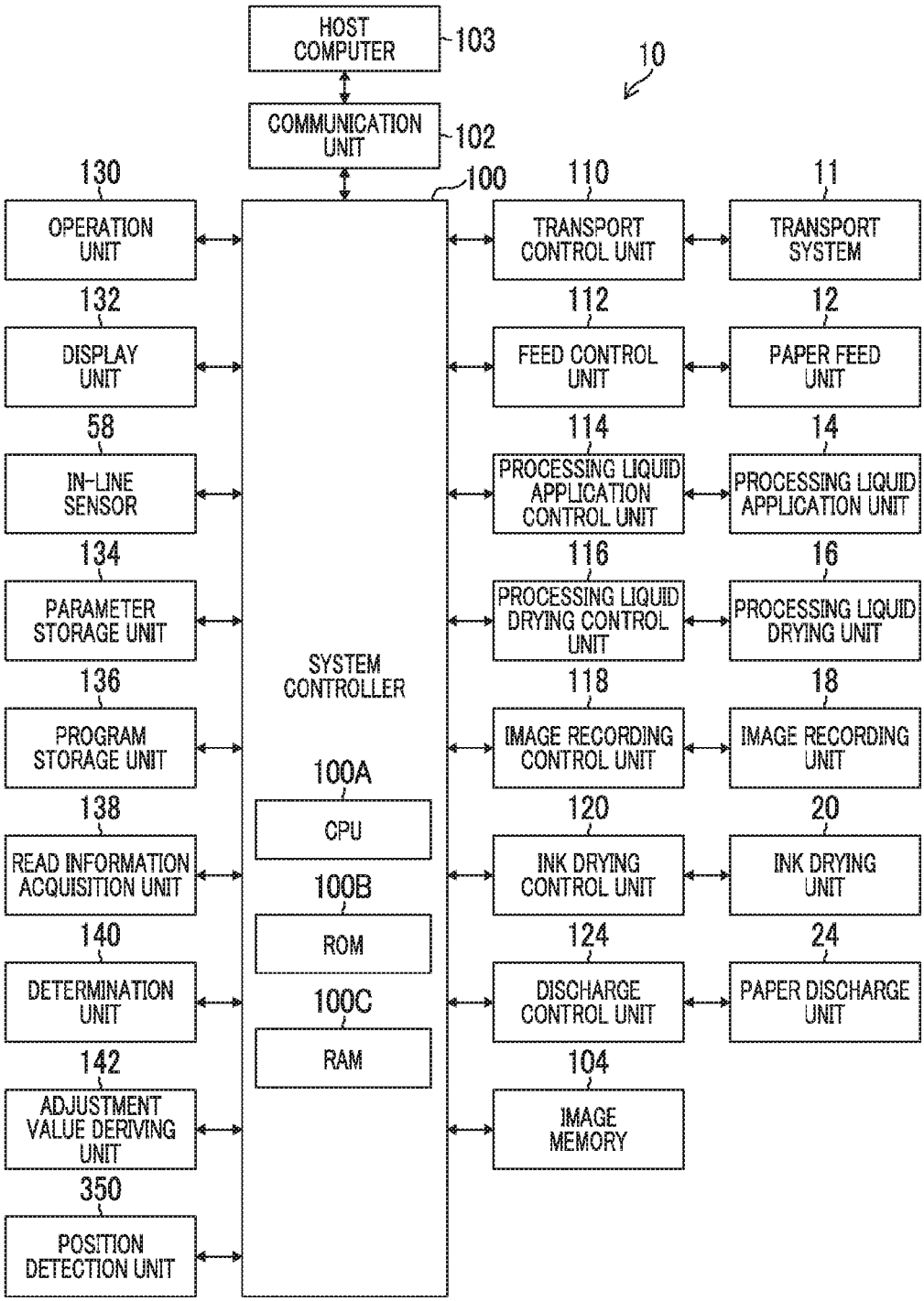
FIG. 18 is a block diagram showing the schematic configuration of a control system of the ink jet recording apparatus shown in FIG. 17.

As described above, adjustment of the X-direction position of the head module 210 with respect to the base frame 212 is performed with high accuracy by detecting the actual X-direction movement distance of the head module 210 using the position detection unit 350 shown in FIG. 18.

The Y-direction position adjusting unit adjusts the Y-direction position of the head module 210 with respect to the base frame 212. The Y-direction position adjusting unit is configured to include the head module Y-direction movable contact member 236, the head module Y-direction movable contact member insertion hole 238, and the head module Y-direction movable contact member position adjusting screw 240 that are shown in FIG. 12.

The Z-direction position adjusting unit adjusts the Z-direction position of the head module 210 with respect to the base frame 212. The Z-direction position adjusting unit is configured to include the head module Z-direction contact member 242 provided in the head module 210, a head module Z-direction contact member insertion hole (not shown), a head module Z-direction contact member position adjusting screw (not shown), and the base frame Z-direction contact member 294 provided in the base frame 212.

In addition, the rotation direction adjusting unit 300 that adjusts the angular deviation of the rotation direction within the plane parallel to the nozzle surface 202 of the head module 210 is provided. In the adjustment of the angular deviation of the rotation direction by the rotation direction adjusting unit 300, the position detection unit 350 used in the X-direction position adjusting unit 249 is also used.

The adjustment of X-direction positional deviation and the adjustment of the angular deviation of the rotation direction can be performed with high accuracy by detecting the actual X-direction movement distance of the head module 210 using the position detection unit 350. In addition, since the position detection unit 350 that detects the X-direction position is also used to monitor the adjustment of X-direction positional deviation and the adjustment of the angular deviation of the rotation direction, it is possible to perform high-accuracy adjustment with a simple configuration. In addition, high-quality image recording is realized using an ink jet head after adjustment.

In the present embodiment, the ink jet head 200 has been described in which a plurality of head modules 210 are arranged in a row along the X direction. However, a two-row zigzag arrangement, a two-dimensional arrangement, and the like can be mentioned as the arrangement of a plurality of head modules 210.

That is, the arrangement of a plurality of head modules 210 may be an X-direction arrangement in which a plurality of head modules 210 is arranged substantially along the X direction.

Application Examples

Figure 16:
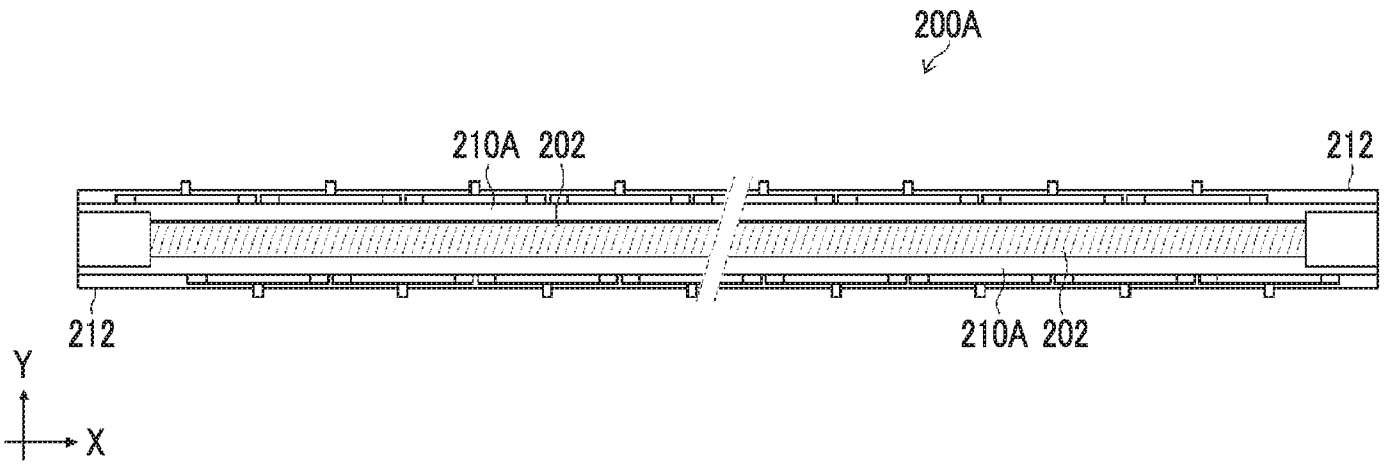
FIG. 16 is a plan view when an ink jet head applied to an application example is viewed from the nozzle surface.

FIG. 16 is a plan view when an ink jet head applied to an application example is viewed from the nozzle surface. In FIG. 16, the same or similar components as the components shown in FIG. 1 are denoted by the same reference numerals, and the explanation thereof will be omitted.

Although the ink jet head 200 including a plurality of head modules 210 has been exemplified in FIG. 1, the adjustment of the angular deviation of the rotation direction within the plane parallel to the nozzle surface 202 can also be applied to an ink jet head 200A including only one head module 210A whose longitudinal direction is the X direction.

In addition, although the ink jet head including a nozzle for jetting liquid, such as ink, has been exemplified as a recording element in the present embodiment and the application example, an electrophotographic recording head including an LED element can also be applied as a recording element.

[Example of the System Configuration]

Figure 17:
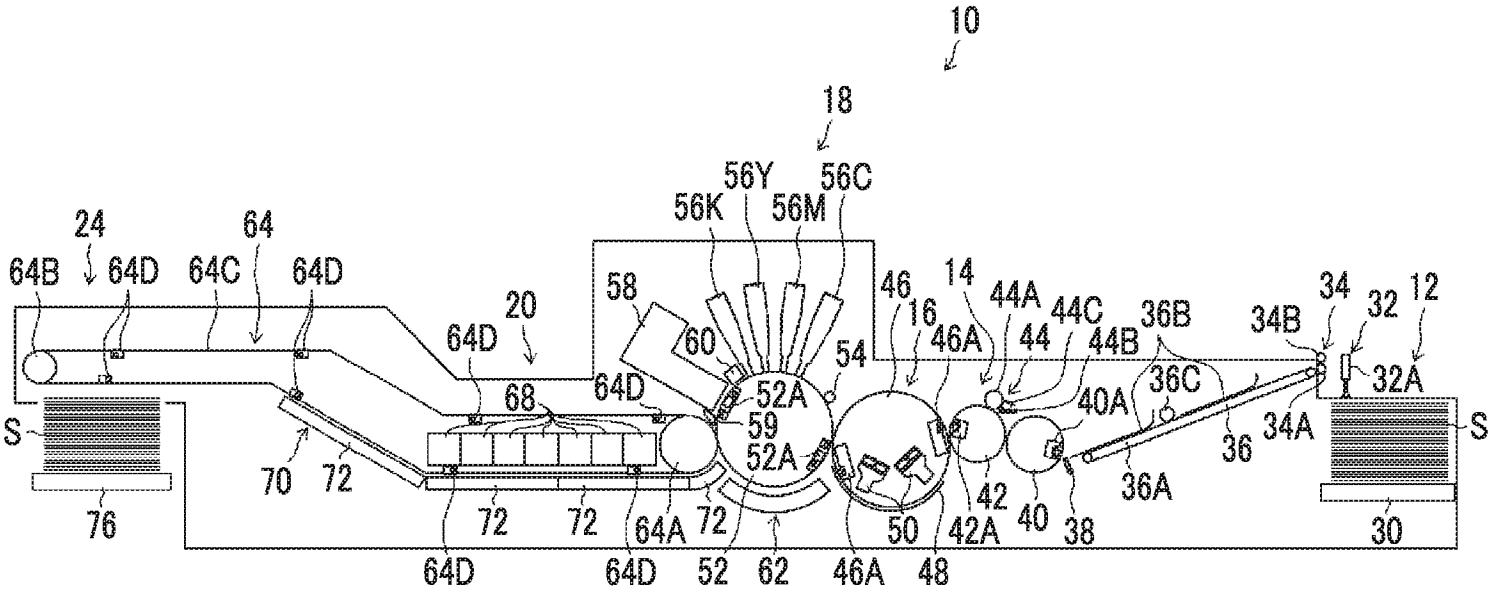
FIG. 17 is a view showing the overall configuration of an ink jet recording apparatus.

FIG. 17 is a diagram showing the overall configuration of an ink jet recording apparatus to which the ink jet heads 200 and 200A described with reference to FIGS. 1 to 16 is applied. The ink jet recording apparatus shown in FIGS. 17 and 18 function as a recording head adjusting system.

An ink jet recording apparatus 10 shown in FIGS. 17 and 18 is an ink jet recording apparatus for recording an image on a sheet of paper S, which is a recording medium, in an ink jet method using aqueous ink.

The ink jet recording apparatus 10 is configured to include: a paper feed unit 12 for feeding the paper S; a processing liquid application unit 14 for applying processing liquid onto the image recording surface of the paper S fed from the paper feed unit 12; a processing liquid drying unit 16 for driving the paper S onto which processing liquid has been applied by the processing liquid application unit 14; an image recording unit 18 for recording an image on the image recording surface of the paper S, which has been dried by the processing liquid drying unit 16, in an ink jet method using aqueous ink; an ink drying unit 20 for drying the paper S on which the image has been recorded by the image recording unit 18; and a paper discharge unit 24 for discharging the paper S that has been dried by the ink drying unit 20.

<Paper Feed Unit>

The paper feed unit 12 is configured to include a paper feed table 30, a soccer device 32, a paper feed roller pair 34, a feeder board 36, a front lay 38, and a paper feed drum 40, and feeds the paper S stacked on the paper feed table 30 to the processing liquid application unit 14 one by one.

The paper S stacked on the paper feed table 30 is pulled up one by one sequentially from the top by a suction fit 32A provided in the soccer device 32, and is fed between a pair of upper and lower rollers 34A and 34B that form the paper feed roller pair 34.

The paper S fed to the paper feed roller pair 34 is fed forward by the upper and lower rollers 34A and 34B and is placed on the feeder board 36. The paper S placed on the feeder board 36 is transported by a tape feeder 36A provided on the transport surface of the feeder board 36.

Then, the transport surface of the feeder board 36 is pressed by a retainer 36B and a guide roller 36C in the transport process, so that unevenness is corrected. The tip of the paper S transported by the feeder board 36 is brought into contact with the front lay 38, so that the inclination is corrected. Then, the paper S is transferred to the paper feed drum 40. Then, the tip portion is gripped by a gripper 40A of the paper feed drum 40, so that the paper S is transported to the processing liquid application unit 14.

<Treatment Liquid Application Unit>

The processing liquid application unit 14 is configured to include a processing liquid application drum 42 for transporting the paper S and a processing liquid application unit 44 for applying predetermined processing liquid onto the image recording surface of the paper S transported by the processing liquid application drum 42, and applies the processing liquid to the image recording surface of the paper S. The term for "apply" includes the concept of coating.

As processing liquid to be applied onto the image recording surface of the paper S, processing liquid having a function of aggregating a coloring material in the aqueous ink jetted onto the paper S by the image recording unit 18 at a later stage is applied. By jetting aqueous ink by applying the processing liquid onto the image recording surface of the paper S, it is possible to perform high-quality printing without causing landing interference or the like even if general-purpose paper is used.

The term for "jetting" in this specification can be read as "recording".

The paper S transferred from the paper feed drum 40 of the paper feed unit 12 is transferred to the processing liquid application drum 42. The processing liquid application drum 42 rotates in a state in which the tip of the paper S is gripped by the gripper 42A, thereby transports the paper S in a state in which the paper S is wound around the peripheral surface.

By pressing an application roller 44A, onto which a predetermined amount of processing liquid metered by a metering roller 44C has been applied from a processing liquid plate 44B, in contact with the image recording surface of the paper S during the transport process, the processing liquid is applied on to the image recording surface of the paper S. In addition, the method of applying the processing liquid is not limited to roller application, and it is also possible to apply other methods, such as an ink jet method and application using a blade.

<Processing Liquid Drying Unit>

The processing liquid drying unit 16 is configured to include a processing liquid drying drum 46 for transporting the paper S, a paper transport guide 48 for supporting the support surface of the paper S, and a processing liquid drying unit 50 for drying the processing liquid by blowing hot air onto the image recording surface of the paper S transported by the processing liquid drying drum 46, and performs drying processing on the paper S having the image recording surface on which the processing liquid has been applied.

The tip of the paper S transferred to the processing liquid drying drum 46 from the processing liquid application drum 42 of the processing liquid application unit 14 is gripped by the gripper 46A provided in the processing liquid drying drum 46.

The support surface of the paper S is supported by the paper transport guide 48 in a state in which the image recording surface, onto which processing liquid has been applied, is toward the inside. The paper S is transported by rotating the processing liquid drying drum 46 in this state.

In the process of being transported by the processing liquid drying drum 46, hot air is blown to the image recording surface of the paper S from the processing liquid drying unit 50 provided inside the processing liquid drying drum 46. Accordingly, since drying processing on the paper S is performed, a solvent component in the processing liquid is removed. As a result, an ink aggregate layer is formed on the image recording surface of the paper S.

<Image Recording Unit>

The image recording unit 18 is configured to include: an image recording drum 52 for transporting the paper S; a paper pressing roller 54 for pressing the paper S transported by the image recording drum 52 so that the paper S is brought into close contact with the peripheral surface of the image recording drum 52; ink jet heads 56C, 56M, 56Y, and 56K for jetting ink droplets of the respective colors of C, M, Y, and K onto the paper S; an in-line sensor 58 for reading an image recorded on the paper S; a mist filter 60 for capturing the ink mist; and a drum cooling unit 62. The image recording unit 18 draws a color image on the image recording surface of the paper S by jetting ink droplets of the respective colors of C, M, Y, and K on the image recording surface of the paper S on which the processing liquid layer is formed.

As the ink jet heads 56C, 56M, 56Y, and 56K shown in FIG. 17, the ink jet head 200 described with reference to FIGS. 1 to 15 and the ink jet head 200A described with reference to FIG. 16 are applied.

Various methods, such as a piezoelectric method of jetting ink using flexural deformation of a piezoelectric element and a thermal method of jetting ink by heating the ink to cause a film boiling phenomenon, can be applied to the ink jet heads 56C, 56M, 56Y, and 56K applied to the present embodiment.

As the ink jet heads 56C, 56M, 56Y, and 56K applied to the present embodiment, a full-line type head is applied in which nozzles are arranged over a length corresponding to the entire width of the paper S. The entire width of the paper S is the total length of the paper S in the width direction of the paper S perpendicular to the transport direction of the paper S.

The tip of the paper S transferred to the image recording drum 52 from the processing liquid drying drum 46 of the processing liquid drying unit 16 is gripped by a gripper 52A provided in the image recording drum 52. In addition, the paper S is made to pass below the paper pressing roller 54, so that the paper S is brought into contact with the peripheral surface of the image recording drum 52.

The paper S in contact with the peripheral surface of the image recording drum 52 is adsorbed by negative pressure generated in a suction hole formed on the peripheral surface of the image recording drum 52. As a result, the paper S is adsorbed and held on the peripheral surface of the image recording drum 52.

When the paper S transported by being adsorbed and held on the peripheral surface of the image recording drum 52 passes through an ink droplet region immediately below each of the ink jet heads 56C, 56M, 56Y, and 56K, ink droplets of the respective colors of C, M, Y, and K are jetted onto the image recording surface from the ink jet heads 56C, 56M, 56Y, and 56K. As a result, a color image is drawn on the image recording surface.

When the paper S on which an image has been recorded by the ink jet heads 56C, 56M, 56Y, and 56K passes through the reading region of the in-line sensor 58, a test chart recorded on the image recording surface is read.

Reading of the image by the in-line sensor 58 is performed when necessary, and abnormality of a nozzle portion, image defects such as density unevenness, and image abnormality are checked from the read data of the image.

The paper S having passed through the reading region of the in-line sensor 58 passes below a guide 59 to be transferred to the ink drying unit 20 after the release of adsorption.

<Ink Drying Unit>

The ink drying unit 20 is configured to include an ink drying processing unit 68 that performs drying processing on the paper S transported by a chain gripper 64, and performs drying processing on the paper S after image recording to remove a liquid component remaining on the image recording surface of the paper S.

As an example of the configuration of the ink drying processing unit 68, a configuration including a heat source, such as a halogen heater and an infrared heater, and a fan for blowing the air heated by the heat source onto the paper S can be mentioned.

The tip of the paper S transferred to the chain gripper 64 from the image recording drum 52 of the image recording unit 18 is gripped by a gripper 64D provided in the chain gripper 64.

The chain gripper 64 has a structure in which a pair of endless chains 64C are wound around a first sprocket 64A and a second sprocket 64B.

The rear end portion of the support surface of the paper S is adsorbed and held on the paper holding surface of a guide plate 72 that is disposed so as to be spaced apart the chain gripper 64 by a predetermined distance.

The paper S on which drying processing has been performed is fed to the paper discharge unit 24 through an inclined transport path 70. A cooling processing unit for performing cooling processing for the paper S passing through the inclined transport path 70 may be included.

<Paper Discharge Unit>

The paper discharge unit 24 for collecting the paper S on which a series of image recording has been performed is configured to include a discharge table 76 for collecting the paper S so as to be stacked.

The gripper 64D of the chain gripper 64 opens the paper S on the discharge table 76 to stack the paper S on the discharge table 76. The discharge table 76 collects the paper S opened from the chain gripper 64 so as to be stacked. In the discharge table 76, a paper lay (not shown) is included so that the paper S is stacked orderly. The paper lay is a comprehensive concept including a front paper lay, a rear paper lay, and a horizontal paper lay.

In addition, the discharge table 76 is provided so as to be movable up and down by a discharge table lifting device (not shown). The driving of the discharge table lifting device is controlled in conjunction with an increase or decrease in the number of pieces of paper S to be stacked on the discharge table 76, thereby moving the discharge table 76 up and down so that the paper S located at the top is always located at a predetermined height.

<Description of a Control System>

FIG. 18 is a block diagram showing the schematic configuration of a control system of the ink jet recording apparatus 10 shown in FIG. 17.

As shown in FIG. 18, the ink jet recording apparatus 10 includes a system controller 100, a communication unit 102, an image memory 104, a transport control unit 110, a feed control unit 112, a processing liquid application control unit 114, a processing liquid drying control unit 116, an image recording control unit 118, an ink drying control unit 120, a discharge control unit 124, an operation unit 130, a display unit 132, and the like.

The system controller 100 functions as an overall control unit that performs overall control of the respective units of the ink jet recording apparatus 10, and functions as a computation unit that performs various computations. The system controller 100 includes a CPU 100A, a ROM 100B, and a RAM 100C.

CPU is an abbreviation of Central Processing Unit, ROM is an abbreviation of Read Only Memory, and RAM is an abbreviation of Random Access Memory.

The system controller 100 also functions as a memory controller that controls the writing of data into memories, such as the ROM 100B, the RAM 100C, and the image memory 104.

Although an example in which memories, such as the ROM 100B and the RAM 100C, are built in the system controller 100 is illustrated in FIG. 18, the memories, such as the ROM 100B and the RAM 100C, may be provided outside the system controller 100.

The communication unit 102 includes a required communication interface, and performs transmission and reception of data to and from a host computer 103 connected to the communication interface.

The image memory 104 functions as a temporary storage unit for various kinds of data including image data, and reading and writing of data is performed through the system controller 100. Image data acquired from the host computer 103 through the communication unit 102 is temporarily stored in the image memory 104. The transport control unit 110 controls the transport of the paper S from the paper feed unit 12 to the paper discharge unit 24, which is the operation of a transport system 11 of the paper S in the ink jet recording apparatus 10. The processing liquid application drum 42, the processing liquid drying drum 46, the image recording drum 52, and the chain gripper 64 shown in FIG. 17 are included in the transport system 11.

The feed control unit 112 controls the operation of each section of the paper feed unit 12 shown in FIG. 17 according to a command from the system controller 100.

The processing liquid application control unit 114 controls the operation of each section of the processing liquid application unit 14 shown in FIG. 17 according to a command from the system controller 100.

The processing liquid drying control unit 116 controls the operation of each section of the processing liquid drying unit 16 shown in FIG. 17 according to a command from the system controller 100.

The image recording control unit 118 functions as a recording control unit that controls ink droplets from the ink jet heads 56C, 56M, 56Y, and 56K, which is the operation of the image recording unit 18 shown in FIG. 17, according to a command from the system controller 100.

The image recording control unit 118 is configured to include: an image processing unit (not shown) for forming dot data from input image data; a waveform generation unit (not shown) for generating a waveform of a driving voltage; a waveform storage unit (not shown) for storing a waveform of a driving voltage; and a driving circuit (not shown) for supplying a driving voltage, which has a driving waveform corresponding to dot data, to each of the ink jet heads 56C, 56M, 56Y, and 56K.

The image processing unit performs color separation processing for separating the input image data into the respective colors of RGB, color conversion processing for converting RGB into CMYK, correction processing such as gamma correction and unevenness correction, and halftone processing for converting the data of each color into a gradation value less than the original gradation value.

A jetting timing and an ink jetting amount at a target recording position that is each pixel position are determined based on the dot data generated by the processing of the image processing unit, and a control signal for determining the jetting timing of each pixel, which is a driving voltage and a driving signal corresponding to the jetting timing and the ink jetting amount at each pixel position, is generated. The driving voltage is supplied to the ink jet heads 56C, 56M, 56Y, and 56K, and a dot is recorded on a recording position by the ink droplets jetted from the ink jet heads 56C, 56M, 56Y, and 56K.

The ink drying control unit 120 controls the operation of the ink drying unit 20 shown in FIG. 17 according to a command from the system controller 100. The ink drying control unit 120 controls the operation of the ink drying processing unit 68, such as drying temperature, a flow rate of drying gas, and the injection timing of drying gas.

The discharge control unit 124 controls the operation of the paper discharge unit 24 according to a command from the system controller 100, so that the paper S is stacked on the discharge table 76 shown in FIG. 17.

The operation unit 130 includes operation members, such as operation buttons, a keyboard, and a touch panel, and transmits operation information input through the operation members to the system controller 100. The system controller 100 performs various kinds of processing according to the operation information transmitted from the operation unit 130.

The display unit 132 includes a display device, such as a liquid crystal panel, and displays information, such as various kinds of setting information of the apparatus and abnormality information, on the display device according to a command from the system controller 100.

The read data output from the in-line sensor 58 is subjected to noise rejection processing, waveform shaping processing, and the like, and is stored in a predetermined memory through the system controller 100.

Various parameters used in the ink jet recording apparatus 10 are stored in the parameter storage unit 134. Various parameters stored in the parameter storage unit 134 are read through the system controller 100, and are set in each unit of the apparatus.

Programs used in each unit of the ink jet recording apparatus 10 are stored in the program storage unit 136. Various programs stored in the program storage unit 136 are read through the system controller 100, and are executed in each unit of the apparatus.

A read information acquisition unit 138 acquires the read data of the test chart formed using the ink jet heads 56C, 56M, 56Y, and 56K. For example, the output signal of the in-line sensor 58 that has read the test chart is acquired.

The angular deviation amount $\theta_Z$ of the rotation direction and the X-direction positional deviation distance for each head module are derived from the read data acquired by the read information acquisition unit 138. That is, the read information acquisition unit 138 and a deviation amount deriving unit, which derives the angular deviation amount $\theta_Z$ of the rotation direction and the X-direction positional deviation distance for each head module function as an information acquisition unit.

A determination unit 140 determines whether or not the derived angular deviation amount $\theta_Z$ of the rotation direction for each head module is outside the allowable range. In addition, it is determined whether or not the X-direction positional deviation distance is outside the allowable range. That is, the determination unit 140 determines whether or not the adjustment of X-direction positional deviation has been performed appropriately, and determines whether or not the adjustment of the angular deviation of the rotation direction has been performed appropriately.

An adjustment value deriving unit 142 derives an angular deviation adjustment value of a head module for which the adjustment of the angular deviation of the rotation direction is required, and derives a reference value of the X-direction movement distance of the head module that is used when determining whether or not the adjustment has been performed appropriately.

In addition, the adjustment value deriving unit 142 derives an X-direction positional deviation adjustment value of a head module for which the adjustment of X-direction positional deviation is required, and derives a reference value of the X-direction movement distance of the head module 210 that is used when determining whether or not the adjustment has been performed appropriately.

After performing the adjustment of the angular deviation of the rotation direction using the rotation direction adjusting unit 300, the X-direction position of the head module to be adjusted is detected by the position detection unit 350. From the history of the X-direction position of the head module being adjusted, the X-direction movement distance of the head module being adjusted is calculated. The position detection unit 350 functions as a position detection unit that detects the X-direction movement distance of the head module 210 when adjusting the angular deviation of the rotation direction.

By monitoring the X-direction movement distance of the head module to be adjusted that has been detected by the position detection unit 350, it is possible to check whether or not the angular deviation amount of the rotation direction of the head module to be adjusted has been adjusted to fall within the allowable range. Accordingly, it is possible to determine whether or not the adjustment has been performed appropriately.

Also for the adjustment of X-direction positional deviation, by monitoring the X-direction movement distance of the head module to be adjusted that has been detected by the position detection unit 350, it is possible to check whether or not the X-direction positional deviation distance of the head module to be adjusted has been adjusted to fall within the allowable range. Accordingly, it is possible to determine whether or not the adjustment has been performed appropriately.

As an example of checking whether or not the X-direction positional deviation distance and the angular deviation amount of the rotation direction of the head module to be adjusted have been adjusted to fall within the allowable range, displaying the information regarding whether or not the adjustment is required on the display unit 132 can be mentioned. That is, the display unit 132 functions as a display unit that displays the determination result of the determination unit 140.

The adjustment of the head module shown in the present embodiment is appropriately performed during the assembly of the ink jet head, in a case where the head module has been replaced, in a case where degradation of image quality due to variations in the jetting characteristics of each head module is observed, and the like.

It is possible to configure an ink jet head adjusting system by extracting the configuration for adjusting the ink jet head in the ink jet recording apparatus shown in the present embodiment. For example, it is possible to configure an ink jet head adjusting system which includes the system controller 100, the display unit 132, the read information acquisition unit 138, the determination unit 140, and the adjustment value deriving unit 142 shown in FIG. 18 and in which the system controller 100 performs overall control of each unit.

In addition, it is preferable that the read information acquisition unit 138, the determination unit 140, the adjustment value deriving unit 142 shown in FIG. 18 and a control unit that performs overall control of the respective units described above are mounted in the ink jet head 200.

In the recording head, the recording head adjusting method and the recording head adjusting system described above, appropriate changes, addition, and deletion are possible without departing from the spirit and scope of the present invention.

EXPLANATION OF REFERENCES

10: ink jet recording apparatus
58: in-line sensor
138: read information acquisition unit
140: determination unit
142: adjustment value deriving unit
200, 200A: ink jet head
202: nozzle surface
210: head module
212: base frame
214: head unit
216: bracket
224: horizontal portion
226: vertical portion
248: eccentric roller
250: plunger
296: X-direction positioning reference pin
300: rotation direction adjusting unit
302: rotation support mechanism
304: Y-direction moving mechanism
350: position detection unit
352: magnetic sensor
354: magnet
404: test chart for rotation direction adjustment

What is claimed is:

1. A recording head, comprising:

a head module having a recording surface on which recording elements are arranged;

a support member that supports the head module;

a first direction position adjusting unit that adjusts a first-direction position of the head module with respect to the support member;

a rotation direction adjusting unit that adjusts angular deviation of a rotation direction within a plane parallel to the recording surface of the head module with respect to the support member; and a position detection unit that detects the first-direction position of the head module with respect to the support member, which is used when performing adjustment by the first direction position adjusting unit and adjustment by the rotation direction adjusting unit, wherein the rotation direction adjusting unit includes a rotation support mechanism, through which a rotation axis of the head module passes along a direction perpendicular to the recording surface and which rotatably supports the head module within the plane parallel to the recording surface, and a second direction moving mechanism that moves an adjustment position of the head module, which is spaced apart from the rotation support mechanism to the first direction, to a second direction perpendicular to the first direction.

2. The recording head according to claim 1, wherein the rotation support mechanism is disposed at one end of the head module in the second direction that is one end of the head module in the first direction and, the second direction moving mechanism is disposed at the one end of the head module in the second direction that is the other end of the head module in the first direction, and the position detection unit comprises a sensor and a detection piece detected by the sensor, and either the sensor or the detection piece is disposed at the other end of the head module in the second direction that is the one end of the head module in the first direction.

3. The recording head according to claim 2, wherein the head module includes a head unit having a recording surface on which recording elements are arranged, and an attachment unit to which the head unit is attached, the attachment unit includes a vertical portion that has a length exceeding a total length of the head unit in the first direction, has protruding portions that protrude to both sides of the head unit, and is provided at the one end of the head module in the second direction so as to be perpendicular to the plane parallel to the recording surface, and in the vertical portion, the rotation support mechanism is provided in one of the protruding portions that protrude to both sides of the head unit in the first direction, and the second direction moving mechanism is provided in the other protruding portion.

4. The recording head according to claim 3, wherein the attachment unit includes a horizontal portion that supports a periphery of a surface of the head unit on an opposite side of the recording surface from the opposite side of the recording surface and that has a structure in which the vertical portion is bonded to the one end in the second direction, and the horizontal portion is at a position corresponding to a position of the rotation support mechanism in the first direction, and either the sensor or the detection piece is disposed at the other end in the second direction.

5. The recording head according to claim 4, wherein the recording head has a structure in which a plurality of the head modules are arranged side by side in the first direction.

6. The recording head according to claim 2, wherein the recording head has a structure in which a plurality of the head modules are arranged side by side in the first direction.

7. The recording head according to claim 3, wherein the recording head has a structure in which a plurality of the head modules are arranged side by side in the first direction.

8. The recording head according to claim 1, wherein the recording head has a structure in which a plurality of the head modules are arranged side by side in the first direction.

9. The recording head according to claim 1, wherein the recording head includes only one of the head module having a structure in which a longitudinal direction is parallel to the first direction.

10. A recording head adjusting method of adjusting the recording head according to claim 1 in which a head module having a recording surface on which recording elements are arranged is supported by a support member, the recording head adjusting method comprising:

a first direction position adjusting step of adjusting a first-direction position of the head module with respect to the support member;

a rotation direction adjusting step of adjusting angular deviation of a rotation direction within a plane parallel to the recording surface of the head module with respect to the support member; and a detection step of detecting the first-direction position of the head module with respect to the support member, which is used in the first direction position adjusting step and the rotation direction adjusting step, wherein, in the rotation direction adjusting step, an adjustment position of the head module spaced apart to the first direction from a rotation support mechanism, through which a rotation axis of the head module passes along a direction perpendicular to the recording surface and which rotatably supports the head module within the plane parallel to the recording surface, is moved to a second direction perpendicular to the first direction.

11. The recording head adjusting method according to claim 10, further comprising:

a determination step of determining whether or not the adjustment of the angular deviation of the rotation direction within the plane parallel to the recording surface of the head module with respect to the support member has been performed appropriately in the rotation direction adjusting step, based on the first-direction position of the head module detected in the detection step.

12. The recording head adjusting method according to claim 11, wherein, in the determination step, as a reference for determining whether or not the adjustment of the angular deviation of the rotation direction within the plane parallel to the recording surface of the head module with respect to the support member has been performed appropriately in the rotation direction adjusting step, a value obtained by multiplying a distance in the second direction from the rotation support mechanism to a first direction detection position of the head module by an adjustment value in the second direction and dividing the value obtained by the multiplication by a first-direction total length of a recording element arrangement region where the recording elements of the head module are arranged is used.

13. A recording head adjusting system comprising the recording head according to claim 1, further comprising:

a recording head which has a structure in which a head module having a recording surface on which recording elements are arranged is supported by a support member, which includes a first direction position adjusting unit that adjusts a first-direction position of the head module with respect to the support member, a rotation direction adjusting unit that adjusts angular deviation of a rotation direction of the head module within a plane parallel to the recording surface, and a position detection unit that detects the first-direction position of the head module with respect to the support member, which is used when performing adjustment by the first direction position adjusting unit and adjustment by the rotation direction adjusting unit, and in which the rotation direction adjusting unit includes a rotation support mechanism, through which a rotation axis of the head module passes along a direction perpendicular to the recording surface and which rotatably supports the head module within the plane parallel to the recording surface, and a second direction moving mechanism that moves an adjustment position of the head module, which is spaced apart from the rotation support mechanism to the first direction, to a second direction perpendicular to the first direction;

an information acquisition unit that acquires an angular deviation amount of the rotation direction within the plane parallel to the recording surface of the head module with respect to the support member;

an adjustment value deriving unit that derives, based on the acquired angular deviation amount, an adjustment value of the second direction moving mechanism when adjusting the angular deviation of the rotation direction within the plane parallel to the recording surface of the head module with respect to the support member; and a determination unit that determines whether or not the adjustment of the angular deviation of the rotation direction within the plane parallel to the recording surface of the head module with respect to the support member has been performed appropriately, based on the first-direction position of the head module detected by the position detection unit, when performing adjustment by the second direction moving mechanism.

14. The recording head adjusting system according to claim 13, wherein, as a reference for determining whether or not the adjustment of the angular deviation of the rotation direction within the plane parallel to the recording surface of the head module with respect to the support member has been performed appropriately, the determination unit uses a value obtained by multiplying a distance in the second direction from the rotation support mechanism to the position detection unit by an adjustment value of the second direction moving mechanism and dividing the value obtained by the multiplication by a first-direction total length of a recording element arrangement region where the recording elements of the head module are arranged.

15. The recording head adjusting system according to claim 14, wherein the adjustment value deriving unit derives a value, which is obtained by multiplying the acquired angular deviation amount of the rotation direction within the plane parallel to the recording surface of the head module with respect to the support member by a distance in the second direction from the rotation support mechanism to the second direction moving mechanism, as an adjustment value of the second direction moving mechanism.

16. The recording head adjusting system according to claim 15, further comprising:

a reading unit that reads a test chart formed using a head module to be adjusted.

17. The recording head adjusting system according to claim 14, further comprising:

a reading unit that reads a test chart formed using a head module to be adjusted.

18. The recording head adjusting system according to claim 13, further comprising:

a reading unit that reads a test chart formed using a head module to be adjusted.

19. The recording head adjusting system according to claim 13, further comprising:

a display unit that displays a determination result of the determination unit.

20. The recording head adjusting system according to claim 13, wherein the recording head includes the recording head according to claim 2.

* * * * *